US005514532A

United States Patent [19]

Sato et al.

[11] Patent Number: 5,514,532

[45] Date of Patent: May 7, 1996

[54] SILVER HALIDE COLOR PHOTOGRAPHIC MATERIAL

[75] Inventors: Tadahisa Sato; Kei Sakanoue, both of Kanagawa, Japan

[73] Assignee: Fuji Photo Film Co., Ltd., Kanagawa, Japan

[21] Appl. No.: 320,589

[22] Filed: Oct. 11, 1994

Related U.S. Application Data

[63] Continuation of Ser. No. 9,962, Jan. 27, 1993, abandoned.

[30] Foreign Application Priority Data

Jan. 28, 1992 [JP] Japan ..... 4-035809

[51] Int. Cl.[6] ..... G03C 7/38; G03C 7/305

[52] U.S. Cl. ..... 430/558; 430/223; 430/380; 430/958; 430/959; 430/955

[58] Field of Search ..... 430/558, 955, 430/959, 380, 223, 958

[56] References Cited

U.S. PATENT DOCUMENTS

| | | | |
|---|---|---|---|
| 3,844,785 | 10/1974 | Puschel et al. | 430/223 |
| 4,338,393 | 7/1982 | Bailey et al. | 430/548 |
| 4,594,313 | 6/1986 | Furutachi et al. | 430/558 |
| 4,619,884 | 10/1986 | Singer | 430/223 |
| 4,684,604 | 8/1987 | Harder | 430/375 |
| 5,134,055 | 7/1992 | Okamura et al. | 430/955 |

FOREIGN PATENT DOCUMENTS

| | | | |
|---|---|---|---|
| 0393720 | 10/1990 | European Pat. Off. . | |
| 1068747 | 3/1989 | Japan | 430/955 |
| 2293746 | 12/1990 | Japan | 430/558 |

*Primary Examiner*—Richard L. Schilling

*Attorney, Agent, or Firm*—Sughrue, Mion, Zinn, Macpeak & Seas

[57] ABSTRACT

A silver halide color photographic material comprising a support having thereon at least one layer containing a hydrazide compound represented by the following formula (1)

$$\mathrm{RNHNHC}\overset{\overset{\mathrm{O}}{\|}}{}\text{—(PA)} \qquad (1)$$

wherein R represents an alkyl group, an aryl group, or an aromatic heterocyclic group and (PA) represents a pyrazoloazole coupler residue or an indazolone coupler residue.

9 Claims, No Drawings

SILVER HALIDE COLOR PHOTOGRAPHIC MATERIAL

This is a Continuation of application Ser. No. 08/009,962, filed on Jan. 27, 1993, now abandoned.

FIELD OF THE INVENTION

The present invention relates to a silver halide color photographic material, and specifically to a silver halide color photographic material having improved graininess and sensitivity. More specifically, the present invention relates to a silver halide color photographic material for in-camera use containing a hydrazide compound releasing a pyrazoloazole series or indazolone series coupler for improving the graininess and the sensitivity of the photographic material.

BACKGROUND OF THE INVENTION

A silver halide color photographic material generally comprises a support having coated thereon light-sensitive layers composed of three kinds of silver halide emulsion layers each selectively sensitized to have light sensitivity to blue light, green light, or red light in a multilayer structure and each silver halide emulsion layer containing a photographic coupler forming a yellow, magenta, or cyan dye. A color image can be obtained by subjecting the color photographic material to color development processing with a color developer after image-exposure.

As a result of the color development, an aromatic primary amine color developing agent undergoes an oxidation coupling reaction with the photographic couplers, which results in forming azomethine series or indophenol series colored dyes. It is important that the colored dyes are clear yellow, magenta, and cyan dyes each having a less side absorption for obtaining a color photographic image showing a good color reproducibility.

Other important properties required for photographic couplers are sufficient color density, high color sensitivity, good graininess (fine dye cloud), etc.

In the case of a silver halide color photographic material for in-camera use, the graininess of the color images and the sensitivity are particularly important. That is, the graininess is important so that photographic images do not roughen when the photographic images is enlarged and sensitivity is important for designing a high-sensitive photographic light-sensitive material which can be used for photography even in a dark place. These properties also greatly influence the kind of silver halide emulsion being used and the design of a color photographic material also becomes easy by using couplers having excellent properties in these points.

Recently, two kinds of pyrazolotriazoles have been developed as magenta couplers providing azomethine dyes having less side absorption and the practical use of these couplers for color photographic materials have been proceeded.

One kind is the 1H-pyrazolo[1,5-b][1,2,4]triazole magenta coupler described in JP-B-2-44051 (the term "JP-B" as used herein means an "examined published Japanese patent application"), U.S. Pat. No. 4,540,654, etc., and another kind is the 1H-pyrazolo[5,1-c][1,2,4]triazole (or also called a 1H-pyrazolo[3,2-c][1,2,4]triazole) magenta coupler described in JP-B-47-27411, U.S. Pat. No. 3,725,067, etc. These magenta couplers have been used for color photographic papers and color photographic negative films and have greatly contributed to the improvement of the color reproducibility and the storage stability.

Furthermore, the imidapyrazoles described in U.S. Pat. No. 4,500,630, the pyrazolotetrazoles described in JP-A-60-33552 (the term "JP-A" as used herein means an "unexamined published Japanese patent application"), the pyrazolobenzimidazoles described in West German Patent 1,070,030, the pyrazoloazoles described in JP-A-60-43,659, and the indazolinones described in West German Patent 814,996 are disclosed as couplers for improving the color reproducibility although they have not yet been practically used.

To improve the graininess of a color photographic material, as the couplers for fining the dye cloud, four equivalent (theoretically, 4 mols of silver halide are required for forming 1 mol of a dye) or more equivalent couplers are preferable. Thus, for using the pyrazolotriazole couplers, etc., described above for this purpose, an increase in the equivalency of these couplers is required but simple four equivalent couplers (i.e., the releasing group is a hydrogen atom) of these couplers have insufficient stability and hence a new approach has been desired.

As a technique for solving this problem, there are the blocked couplers disclosed in JP-A-56-133734 and JP-A-60-191253. The coupler is, for example, a coupler formed by introducing a pyrazolotriazole coupler having a ballast group into the releasing group portion of a yellow coupler forming a water-soluble azomethine dye and is so designed that after coloring the yellow coupler, the pyrazolotriazole coupler, which becomes colorable upon release, colors and remains in the film, while the yellow dye flows out in the developer, whereby the coupler can become an apparent four to six equivalent coupler.

However, the couplers described in the above-described patent publications have problems in that the flowout of the water-soluble dye formed after development processing is insufficient (inferior decoloring), the improvement in the graininess and the sensitivity is insufficient, and further the synthesis of these couplers is difficult. Thus it has been desired to solve the problems.

Also, there is a method of adding hydroquinones or gallic acids each having a non-diffusible group but in this case, in particular, in a color reversal photographic light-sensitive material, there is the problem that in the first development (black and white development), the compound accelerates silver development resulting in a deterioration in graininess.

SUMMARY OF THE INVENTION

Thus, as the result of various investigations for solving these problems, it has now been discovered that a hydrazine derivative with a pyrazoloazole or indazolinone moiety in the molecule can become a polyequivalent coupler and that the coupler can solve the foregoing problems. That is, it has been discovered that a silver halide color photographic material containing at least one hydrazide compound represented by general formula (I) shown below:

$$\mathrm{RNHNHC}\overset{\overset{\mathrm{O}}{\|}}{}\text{—(PA)} \qquad \text{(I)}$$

wherein

R represents an alkyl group, an aryl group, or an aromatic heterocyclic group and (PA) represents a pyrazoloazole coupler residue or an indazolone coupler residue; is effective for solving the above-described problems and have succeeded in accomplishing the present invention.

DETAILED DESCRIPTION OF THE INVENTION

The hydrazide compound shown by formula (I) used in the present invention is explained in detail below.

In formula (I) described above, R represents an alkyl group, an aryl group, or an aromatic heterocyclic group, and specifically represents a straight chain or branched chain alkyl group having from 1 to 40 carbon atoms, an aryl group having from 6 to 40 carbon atoms, or an aromatic heterocyclic group having from 1 to 40 carbon atoms and containing one or more of a nitrogen atom, a sulfur atom, or an oxygen atom. These groups each may have a substituent such as a halogen atom, an alkyl group, an aryl group, a heterocyclic group, a cyano group, a hydroxy group, a nitro group, a carboxy group, a sulfo group, an amino group, an alkoxy group, an aryloxy group, an acylamino group, an alkylamino group, an anilino group, a ureido group, a sulfamoylamino group, an alkylthio group, an arylthio group, an alkoxycarbonylamino group, a sulfonamido group, a carbamoyl group, a sulfamoyl group, a sulfonyl group, an alkoxycarbonyl group, a heterocyclic oxy group, an azo group, an acyloxy group, a carbamoyloxy group, a silyl group, a silyloxy group, an aryloxycarbonylamino group, an imido group, a heterocyclic thio group, a sulfinyl group, a phosphonyl group, an aryloxycarbonyl group, an acyl group, an azolyl group, etc.

Furthermore, R may form a bis compound as a divalent group.

More specifically, R represents an alkyl group such as methyl, ethyl, propyl, isopropyl, t-butyl, decyl, tridecyl, 1,1-dimethylpropyl, 2-methanesulfonylethyl, 3-(3 -pentadecylphenoxy)propyl, 3-{4-[2-(4-(4-hydroxyphenylsulfonyl)phenoxy)dodecanamido]phenyl}propyl, 2-ethoxytridecyl, trifluoromethyl, cyclopentyl, 3-(2,4-di-t-amylphenoxy)propyl, etc.; an aryl group such as phenyl, 4-t-butylphenyl, 2,4-di-t-amylphenyl, 2,4,6-trimethylphenyl, 4 -tetradecanamidophenyl, 3-ethoxycarbonylphenyl, 3-dodecyloxycarbonylphenyl, 3-dioctylaminocarbonylphenyl, 4-ethoxycarbonylphenyl, 4-methanesulfonamidophenyl, 4-(2-octyloxy-5-t-octylbenzenesulfonamido)phenyl, 3-carboxyphenyl, 3sulfophenyl, 4-dodecyloxyphenyl, 2-chlorophenyl, 4-hydroxyphenyl, 2-hydroxyphenyl, 3-carbamoylphenyl, 2-naphthyl, 1-naphthyl, 2-octadecyloxycarbonyl-1-naphthyl, 4-sulfo-1-naphthyl, etc.; or an aromatic heterocyclic group such as 2-furyl, 2-thienyl, 1-methyl-2-pyrrolyl, 2 -pyridinyl, 4-pyridinyl, 2-pyrimidinyl, 2-benzothiazolyl, 5 -tetrazolyl, etc.

R is preferably an aryl group or an aromatic heterocyclic group, and particularly preferably is an aryl group.

(PA) is explained in detail below.

More particularly, (PA) represents a pyrazoloazole coupler residue or an indazolone coupler residue, and specifically represents 1H-imidazo[1,2-b]pyrazole shown by the following formula [M-I], 1H-pyrazolo[1,5-b][1,2,4] -triazole shown by the following formula [M-II], 1H-pyrazolo[5,1-c][1,2,4]triazole shown by the following formula [M-III], 1H-pyrazolo[1,5-d]tetrazole shown by the following formula [M-IV], 1H-pyrazolo[1,5-a]benzimidazole shown by the following formula [M-V], 1H-pyrazolo[1,5-b]pyrazole shown by the following formula [M-VI], or 3 -indazolone shown by the following formula [M-VII].

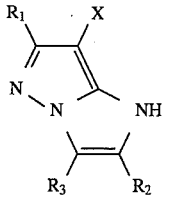

(M-I)

-continued

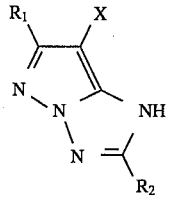

(M-II)

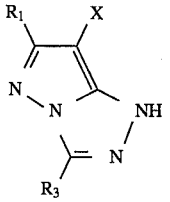

(M-III)

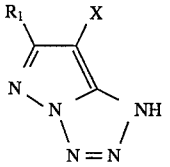

(M-IV)

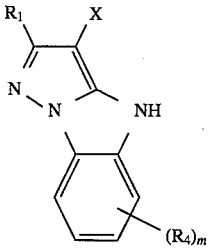

(M-V)

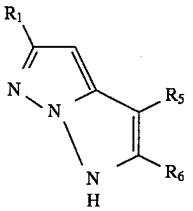

(M-VI)

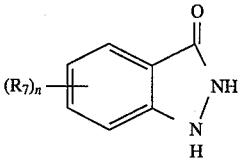

(M-VII)

$R_1$, $R_2$, $R_3$, $R_4$, $R_5$, $R_6$, $R_7$, m, n, and X in the above formulae are explained in detail below.

$R_1$ to $R_7$ each represents a hydrogen atom or a substituent and the substituent is same as the substituent for the alkyl group and the aryl group shown by R described above in regard to formula (I).

More specifically, $R_1$ represents a hydrogen atom, a halogen atom (e.g., chlorine and bromine), an alkyl group (e.g., a straight chain or branched chain alkyl group having from 1 to 32 carbon atoms, an aralkyl group, an alkenyl group, an alkinyl group, a cycloalkyl group, and a cycloalkenyl group, specifically, for example, methyl, ethyl, propyl, isopropyl, t-butyl, tridecyl, 2-methanesulfonylethyl, 3-(3-pentadecylphenoxy)propyl, 3-{4-{2-[4 -(4-hydroxyphenylsulfonyl)phenoxy]dodecanamido}phenyl}-propyl, 2-ethoxytridecyl, trifluoromethyl, cyclopentyl, and 3-(2,4-di-t-amylphenoxy)propyl), an aryl group (e.g., phenyl, 4-t-butylphenyl, 2,4-di-t-amylphenyl, 2,4,6-trimethylphenyl, 3-tridecanamido-2,4,6-trimethylphenyl, and 4-tetradecanamidophenyl), a heterocyclic group (e.g., 2-furyl, 2-thienyl, 2-pyrimidinyl, and 2-benzothiazolyl), a cyano group, a hydroxy group, a nitro group, a carboxy group, a sulfo group, an amino group, an alkoxy group (e.g., methoxy, ethoxy, 2-methoxyethoxy, 2-dodecylethoxy, and 2-methanesulfonylethoxy), an aryloxy group (e.g., phenoxy, 2-methylphenoxy, 4-t-butylphenoxy, 3-nitrophenoxy, 3-t-butyloxycarbamoylphenoxy, and 3-methoxycarbamoyl), an acylamino group (e.g., acetamido, benzamido, tetradecanamido, 2-(2,4-di-t-amylphenoxy)butanamido, 4-(3-t-butyl-4-hydroxyphenoxy)butanamido, and 2-{4-(4-hydroxyphenylsulfonyl)phenoxy}decanamido), an alkylamino group (e.g., methylamino, butylamino, dodecylamino, diethylamino, and methylbutylamino), an anilino group (e.g., phenylamino, 2-chloroanilino, 2-chloro-5-tetradecanaminoanilino, 2-chloro-5-dodecyloxycarbonylanilino, N-acetylanilino, and 2-chloro-5-{2-(3-t-butyl-4-hydroxyphenoxy)dodecanamido}anilino), a ureido group (e.g., phenylureido, methylureido, and N,N-dibutylureido), a sulfamoylamino group (e.g., N,N-di-propylsulfamoylamino and N-methyl-N-decylsulfamoylamino), an alkylthio group (e.g., methylthio, octylthio, tetradecylthio, 2-phenoxyethylthio, 3-phenoxypropylthio, and 3-(4-t-butylphenoxy)propylthio), an arylthio group (e.g., phenylthio, 2-butoxy-5-t-octylphenylthio, 3-pentadecylphenylthio, 2-carboxyphenylthio, and 4-tetradecanamidophenylthio), an alkoxycarbonylamino group (e.g., methoxycarbonylamino and tetradecyloxycarbonylamino), a sulfonamido group (e.g., methanesulfonamido, hexadecanesulfonamido, benzenesulfonamido, p-toluenesulfonamido, octadecanesulfonamido, and 2-methoxy-5-t-butylbenzenesulfonamido), a carbamoyl group (e.g., N-ethylcarbamoyl, N,N-dibutylcarbamoyl, N-(2-dodecyloxyethyl)carbamoyl,N-methyl-N-dodecylcarbamoyl, and N-{3-(2,4-di-t-amylphenoxy)propyl} -carbamoyl), a sulfamoyl group (e.g., N-ethylsulfamoyl, N,N-dipropylsulfamoyl, N-(2-dodecyloxyethyl)sulfamoyl, N-ethyl-N-dodecylsulfamoyl, and N,N-diethylsulfamoyl), a sulfonyl group (e.g., methanesulfonyl, octanesulfonyl, benzenesulfonyl, and toluenesulfonyl), an alkoxycarbonyl group (e.g., methoxycarbonyl, butyloxycarbonyl, dodecyloxycarbonyl, carbonyl, and octadecyloxycarbonyl), a heterocyclic oxy group (e.g., 1-phenyltetrazole-5-oxy and 2-tetrahydropyranyloxy), an azo group (e.g., phenylazo, 4-methoxyphenylazo, 4-pivaloylaminophenylazo, and 2-hydroxy- 4-propanoylazo), an acyloxy group (e.g., acetoxy), a carbamoyloxy group (e.g., N-methylcarbamoyloxy and N-phenylcarbamoyloxy), a silyl group (e.g., trimethylsilyl, t-butyldimethylsilyl, and triphenylsilyl), a silyloxy group (e.g., trimethylsilyloxy and dibutylmethylsilyloxy), an aryloxycarbonylamino group (e.g., phenoxycarbonylamino), an imido group (e.g., N-succinimido, N-phthalimido, and 3 -octadecenylsuccinimido), a heterocyclic thio group (e.g., 2-benzothiazolylthio, 2,4-diphenoxy-1,3,5-triazole-6-thio, and 2-pyridylthio), a sulfinyl group (e.g., dodecanesulfinyl, 3-pentanedecylphenylsulfinyl, and 3 -phenoxypropylsulfinyl), a phosphonyl group (e.g., phenoxyphosphonyl, octyloxyphosphonyl, and phenylphosphonyl), an aryloxycarbonyl group (e.g., phenoxycarbonyl), an acyl group (e.g., acetyl, 3-phenylpropanoyl, benzoyl, and 4-dodecyloxybenzoyl), or an azolyl group (e.g., imidazolyl, pyrazolyl, 3-chloro-pyrazol-1-yl, and triazolyl).

In these substituents, the substituents, which can further have a substituent, may have an organic substituent connected with a carbon atom, an oxygen atom, a nitrogen atom, or a sulfur atom or have a halogen atom.

Of these substituents shown by $R_1$, preferred substituents are an alkyl group, an aryl group, an alkoxy group, an aryloxy group, an alkylthio group, a ureido group, a urethane group, and an acylamino group.

The substituents shown by $R_2$, $R_5$, and $R_6$ are the same groups as the substituents illustrated above on $R_1$, and are preferably a hydrogen atom, an alkyl group, an aryl group, a heterocyclic group, an alkoxycarbonyl group, a carbamoyl group, a sulfamoyl group, a sulfinyl group, an acyl group, and a cyano group.

The substituents shown by $R_3$, are also the same groups as the substituents illustrated above on $R_1$, and are preferably a hydrogen atom, an alkyl group, an aryl group, a heterocyclic group, an alkoxy group, an aryloxy group, an alkylthio group, an arylthio group, an alkoxycarbonyl group, a carbamoyl group, and an acyl group, and more preferably are an alkyl group, an aryl group, a heterocyclic group, an alkylthio group, and an arylthio group.

Also, the substituents shown by $R_4$ and $R_7$ are the same groups as the substituents illustrated above on $R_1$, and preferably are a hydrogen atom, an alkyl group, an aryl group, a heterocyclic group, an alkoxy group, an aryloxy group, an alkoxycarbonyl group, a carbamoyl group, a sulfamoyl group, a sulfonyl group, an acyl group, an acylamino group, an alkoxycarbonylamino group, a sulfonamido group, a sulfamoyl group, and a cyano group.

Furthermore, m and n each represents an integer of from 1 to 4, and preferably an integer of from 1 to 3.

Also, X represents a hydrogen atom or a group releasable on reaction of the hydrazide compound shown by formula (I) and the oxidation product of an aromatic primary amine color developing agent and, as the releasable group, there are a halogen atom, an alkoxy group, an aryloxy group, an acyloxy group, an alkylsulfonyloxy group, an arylsulfonyloxy group, an acylamino group, an alkylsulfonamido group, an arylsulfonamido group, an alkoxycarbonyloxy group, an aryloxycarbonyloxy group, an alkylthio group, an arylthio group, a heterocyclic thio group, a carbamoylamino group, a 5-membered or 6-membered nitrogen-containing heterocyclic group, an imido group, or an arylazo group.

These groups may be further substituted with groups illustrated above as the substituent for the group shown by $R_1$.

More specifically, X represents a halogen atom (e.g., fluorine, chlorine, and bromine), an alkoxy group (e.g., ethoxy, dodecyloxy, methoxyethylcarbamoylmethoxy, carboxypropyloxy, methylsulfonylethoxy, and ethoxycarbonylmethoxy), an aryloxy group (e.g., 4-methylphenoxy, 4-chlorophenoxy, 4-methoxyphenoxy, 4-carboxyphenoxy, 3 -ethoxycarbonylphenoxy, 4-methoxycarbonylphenoxy, 3 -acetylaminophenoxy, and 2-carboxyphenoxy), an acyloxy group (e.g., acetoxy, tetradecanoyloxy, and benzoyloxy), an alkyl- or arylsulfonyloxy group (e.g., methanesulfonyloxy and toluenesulfonyloxy), an acylamino group (e.g., dichloroacetylamino and heptafluorobutyrylamino), an alkyl- or arylsulfonamido group (e.g., methanesulfonamino, trifluoromethanesulfonamino, and p-toluenesulfonylamino), an alkoxycarbonyloxy group (e.g., ethoxycarbonyloxy and benzyloxycarbonyloxy), an aryloxycarbonyloxy group (e.g., phenoxycarbonyloxy), an alkyl-, aryl- or heterocyclic thio group (e.g., dodecylthio, 1-carboxydodecylthio, phenylthio, 2-butoxy-5-t-octylphenylthio, 2-benzyloxycarbonylaminophenylthio, and tetrazolylthio), a carbamoylamino group (e.g., N-methylcarbamoylamino and N-phenylcarbamoylamino), a 5-membered or 6-membered nitrogen-containing heterocyclic group (e.g., 1-imidazolyl, 1-pyrazolyl, 1,2,4-triazol-1-yl, tetrazolyl, 3,5-dimethyl-1-pyrazolyl, 4-cyano-1-pyrazolyl, 4-methoxycarbonyl-1-pyrazolyl, 4-acetylamino-1-pyrazolyl, and 1,2-dihydro-2-oxo-1-pyridyl), an imido group (e.g., succinimido and hydantoinyl), or an arylazo group (e.g., phenylazo and 4-methoxyphenylazo).

As the case may be, X may be an aldehyde or a ketone as a releasing group bonded through a carbon atom in addition to the above-described groups and in this case, the coupler may form a bis-type coupler obtained by condensing four equivalent couplers.

Also, X may contain a photographically useful group such as a development inhibitor, a development accelerator, etc.

X is preferably a halogen atom, an alkoxy group, an aryloxy group, an alkylthio group, an arylthio group, or a 5-membered or 6-membered nitrogen-containing heterocyclic group bonded to the coupling active position through a nitrogen atom, and particularly preferably a halogen atom, a substituted aryloxy group, a substituted arylthio group, or a substituted 1-pyrazolyl group.

Also, R in formula (I) or $R_1$ to $R_7$ or X in (PA) may be a divalent group forming a bis-compound.

When the moiety shown by formula (I) is present in a vinyl monomer as a substituent, the vinyl monomer is linked to the moiety shown by R in formula (I) or $R_1$ to $R_7$ or X in (PA), and the linkage group is an alkylene group (a substituted or unsubstituted alkylene group, such as, for example, methylene, ethylene, 1,10-decylene, and —$CH_2CH_2OCH_2CH_2$—), a phenylene group (a substituted or unsubstituted phenylene group, such as, for example, 1,4-phenylene, 1,3-phenylene, 2,5-dimethyl-1,3-phenylene and 2,5-dichloro-1,3-phenylene), —NHCO—, —CONH—, —O—, —OCO—, or an aralkylene group (e.g., —$CH_2C_6H_4CH_2$—, —$CH_2CH_2C_6H_4CH_2CH_2$—, and —$CH_2C_6H_2Cl_2$—), and these groups may be appropriately combined.

Preferred examples of these linkage groups are —$CH_2CH_2$—, —$CH_2CH_2CH_2C_6H_4NHCO$—*, —$C_6H_4NHCO$—*, —$CH_2CH_2NHCO$—*, —$CH_2CH_2OCO$—*, —$CH_2CH_2OCH_2CH_2NHCO$—*, and —$CH_2CH_2C_6H_4CH_2CH_2NHCO$—*, wherein the mark (*) shows the linking position to the vinyl copolymer.

In addition, the vinyl group of the foregoing vinyl monomer may have a substituent other than formula (I), and preferred examples of substituents are a chlorine atom and a lower alkyl group having from 1 to 4 carbon atoms (e.g., methyl and ethyl).

The vinyl monomer having the moiety shown by formula (I) described above in the molecule may be copolymerized with a non-coloring ethylenically unsaturated monomer which does not undergo a coupling reaction with the oxidation product of an aromatic primary amine developing agent.

Examples of non-coloring ethylenically unsaturated monomers which do not undergo a coupling reaction with the oxidation product of an aromatic primary amine developing agent are acrylic acid, α-chloroacrylic acid, α-alkylacrylic acids (e.g., methacrylic acid), and the esters and amides of these acrylic acids (e.g., acrylamide, n-butylacrylamide, t-butylacrylamide, diacetonacrylamide, methacrylamide, methyl acrylate, ethyl acrylate, n-propyl acrylate, n-butyl acrylate, t-butyl acrylate, iso-butyl acrylate, 2-ethylhexyl acrylate, n-octyl acrylate, lauryl acrylate, methyl methacrylate, ethyl methacrylate, n-butyl methacrylate, and β-hydroxy methacrylate), methylene dibisacrylamide, vinyl esters (e.g., vinyl acetate, vinyl propionate, and vinyl laurate), acrylonitrile, methacrylonitrile, aromatic vinyl compounds (e.g., styrene, styrene derivatives, vinyltoluene, divinylbenzene, vinylacetophenone, and sulfostyrene), itaconic acid, citraconic acid, crotonic acid, vinylidene chloride, vinyl alkyl ethers (e.g., vinyl ethyl ether), maleic acid, maleic anhydride, maleic acid esters, N-vinyl-2-pyrrolidone, N-vinylpyridine, 2-vinylpyridine, and 4-vinylpyridine.

The non-coloring ethylenically unsaturated monomers may be used alone or as a combination thereof. Examples of suitable combinations are n-butyl acrylate and methyl acrylate, styrene and methacrylic acid, methacrylic acid and acrylamide, and methyl acrylate and diacetone acrylamide.

The non-coloring ethylenically unsaturated monomer copolymerized with a solid water-insoluble monomeric hydrazide compound can be selected such that the physical properties and/or the chemical properties of the copolymer formed, such as the solubility, the compatibility of the copolymer with a binder of the photographic colloid composition, such as gelatin, the flexibility thereof, the heat stability, etc., are influenced advantageously as is well-known in the field of polymer couplers.

The polymer hydrazide compound used in the present invention may be water soluble or water insoluble and of these compounds, a polymer latex is particularly preferable.

The site of the coupler shown by (PA) in formula (I), that is, shown by one of the formulae [M-I] to [M-VII] bonded to a carbonyl group is the site of the nitrogen atom shown by —NH— in the formula [M-I] to [M-VII] or the site of the nitrogen atom or the carbon atom where an electron pair can localize in the resonance structural formula obtained by transferring of the isolated electron pair on the nitrogen atom based on organic electron theory.

The preferred bonding site to the carbonyl group is the site of the foregoing nitrogen atom, and the more preferred bonding site is the site of the nitrogen atom shown by —NH—.

In the pyrazoloazoles shown by formulae [M-I] to [M-VII], (PA) is preferably a pyrazoloazole or an indazolone shown by formula [M-I], [M-II], [M-III], [M-V], or [M-VII], more preferably a pyrazoloazole shown by formula [M-III] or [M-V], and particularly preferably the pyrazolotriazole shown by the formula [M-III].

Specific examples of hydrazide compounds represented by formula (I) are illustrated below but the present invention is not to be construed as being limited to these examples.

(M-1)
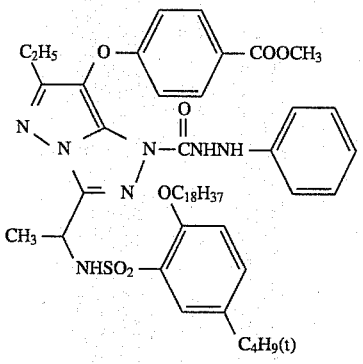
(M-2)
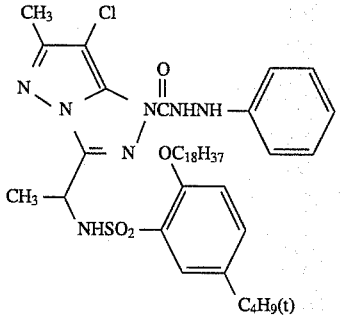
(M-3)
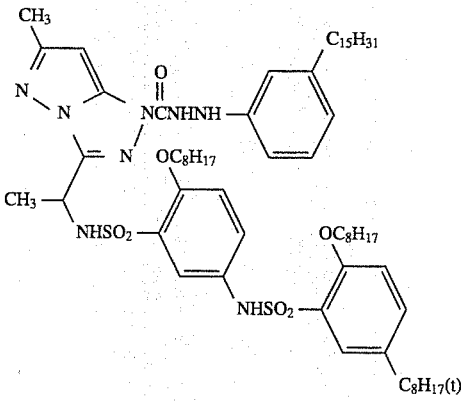
(M-4)
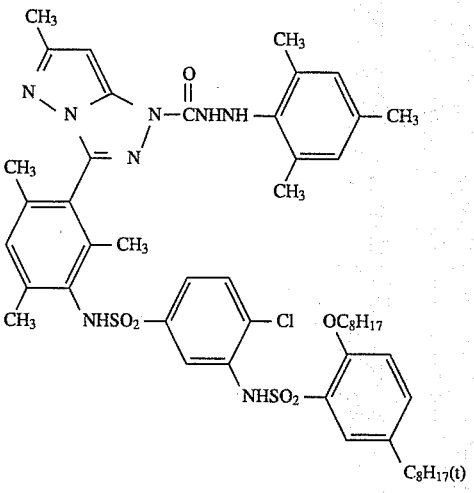
(M-5)
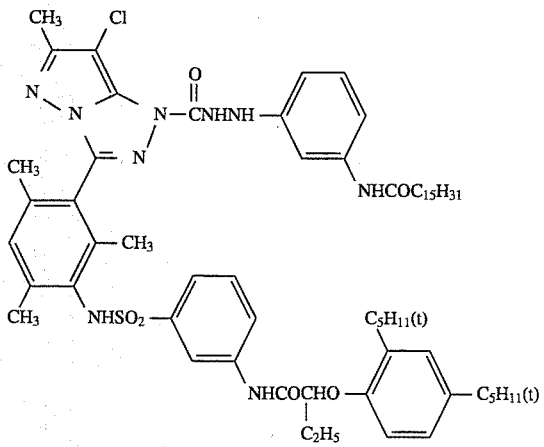
(M-6)
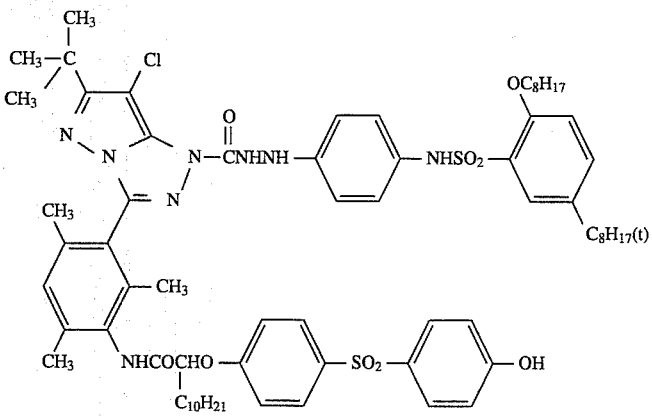

-continued
(M-7)
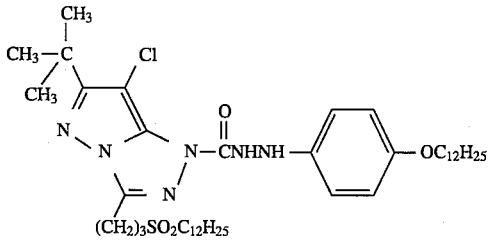
(M-8)
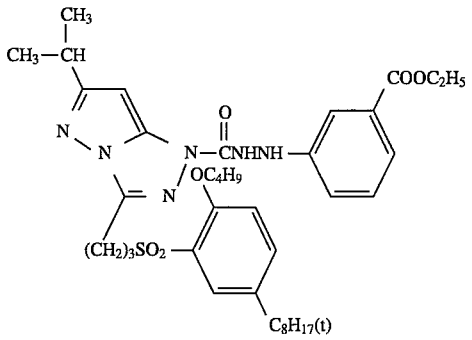
(M-9)
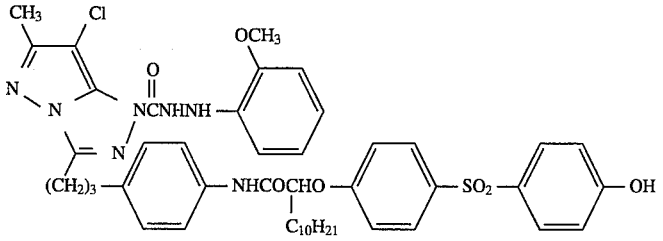
(M-10)
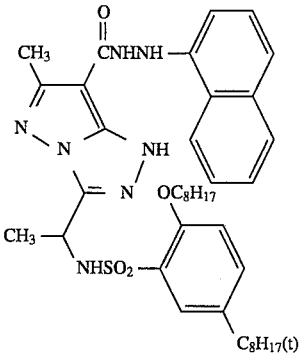
(M-11)
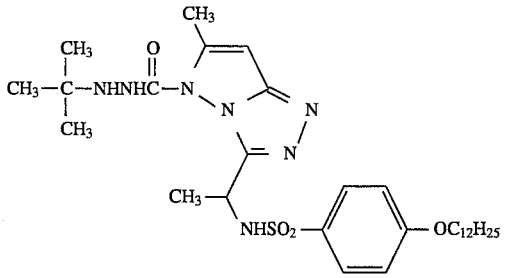
(M-12)
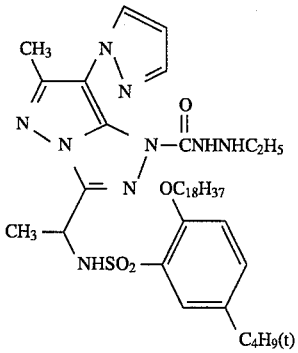
(M-13)
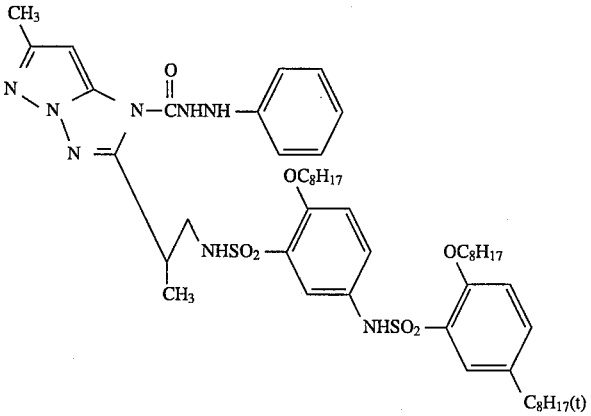

-continued
(M-14)
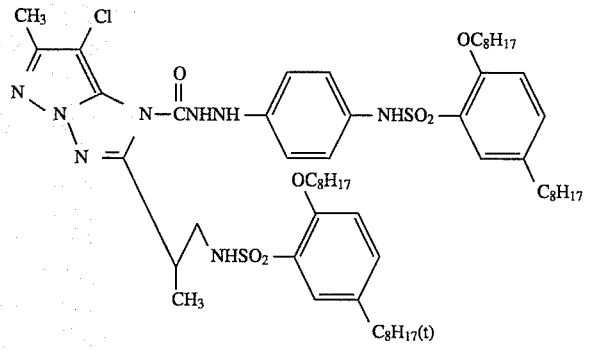
(M-15)
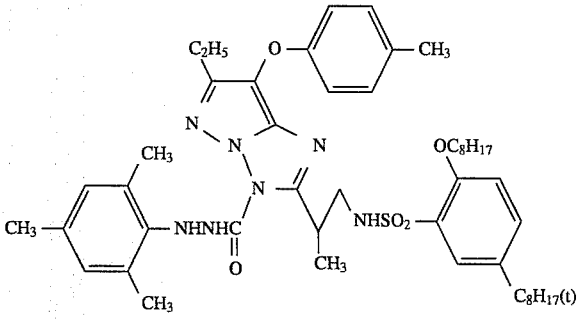
(M-16)
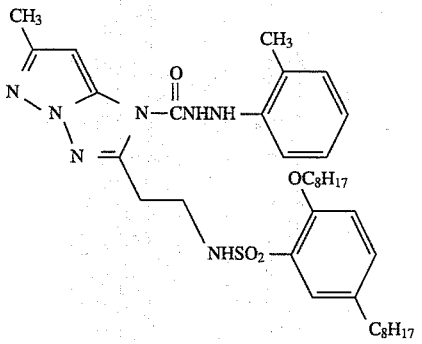
(M-18)
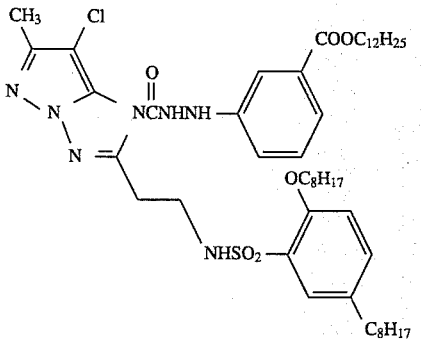
(M-19)
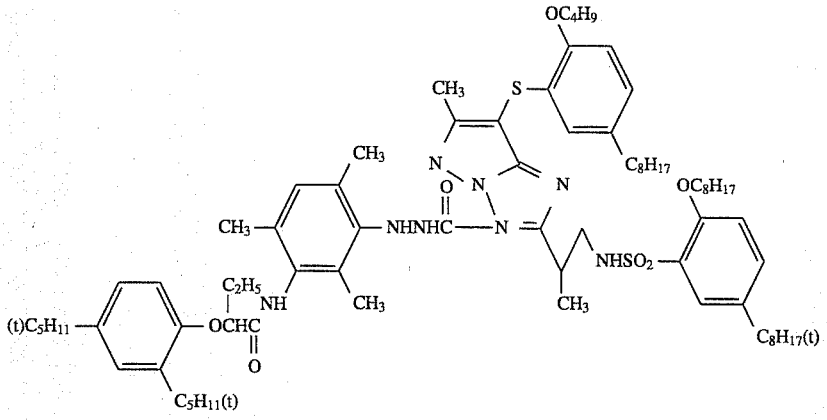

-continued
(M-20)
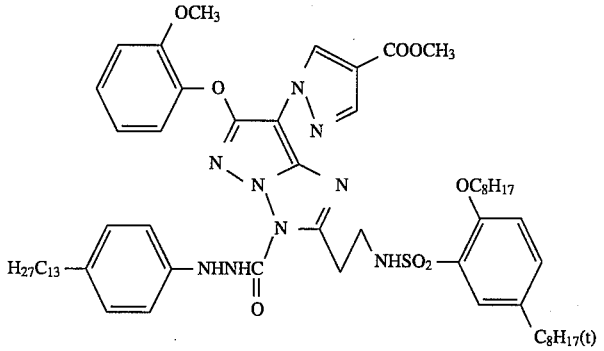
(M-21)
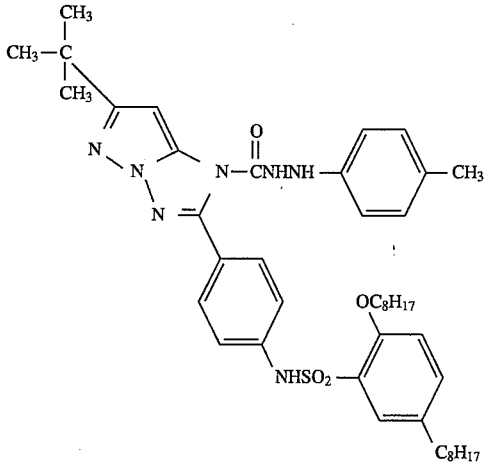
(M-22)
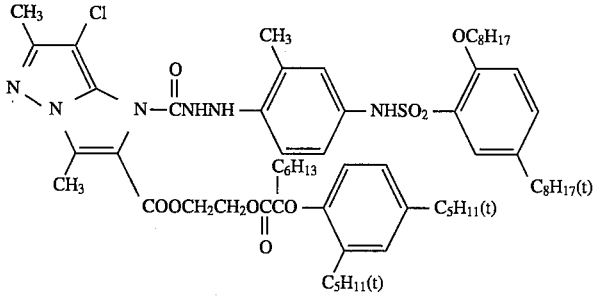
(M-23)
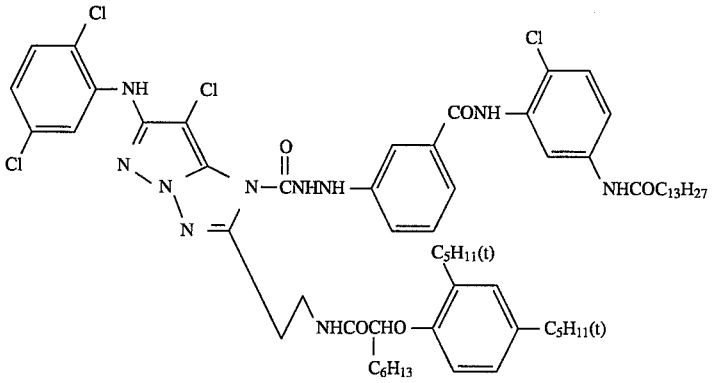
(M-24)
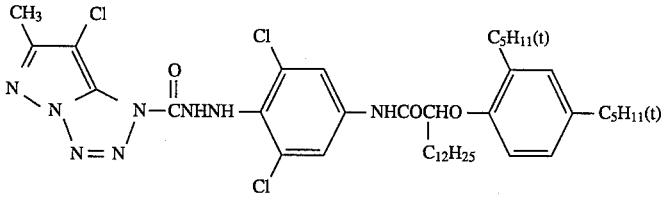

-continued
(M-25)
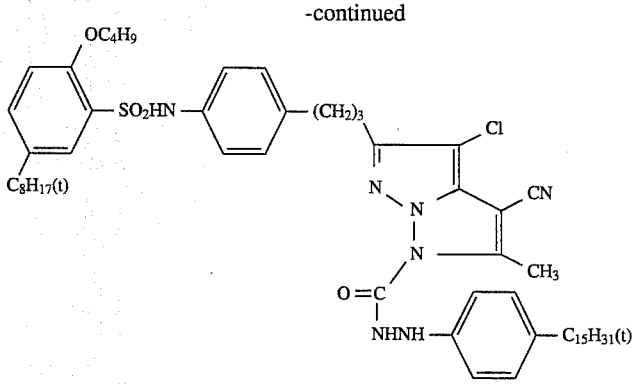
(M-26)
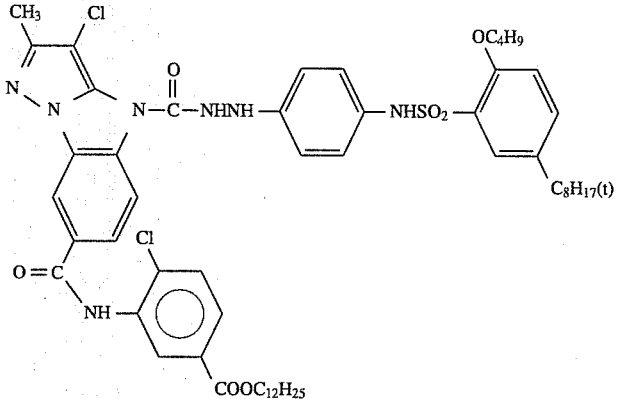
(M-27)
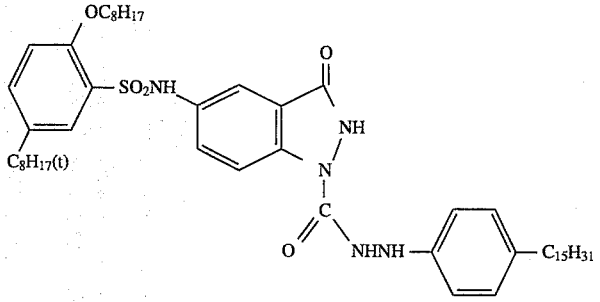
(M-28)
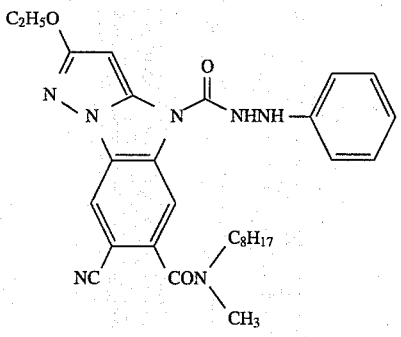
(M-29)
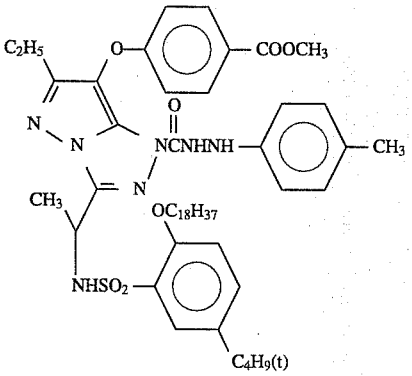

-continued
(M-30)
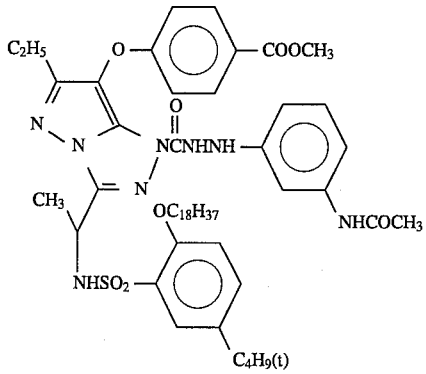
(M-31)
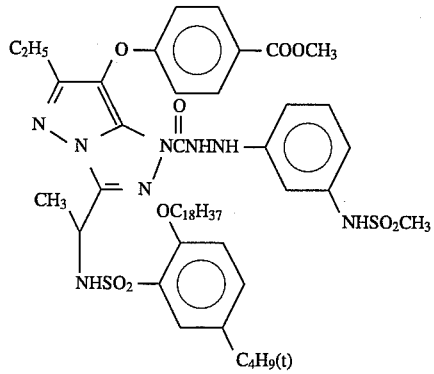
(M-32)
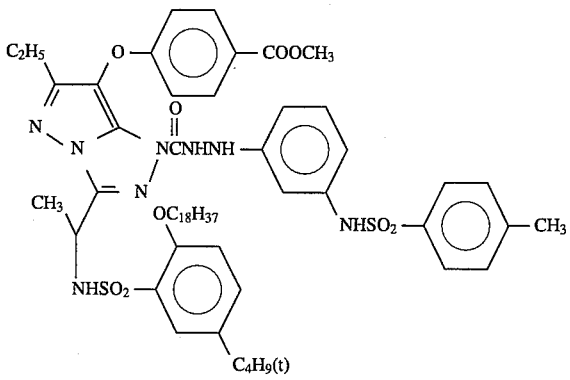
(M-33)
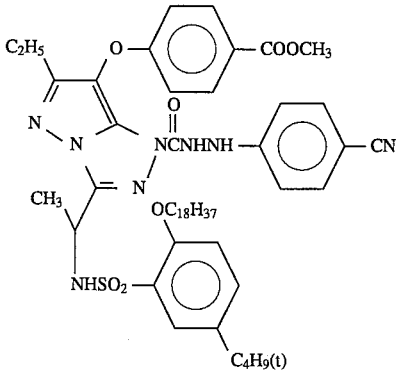
(M-34)
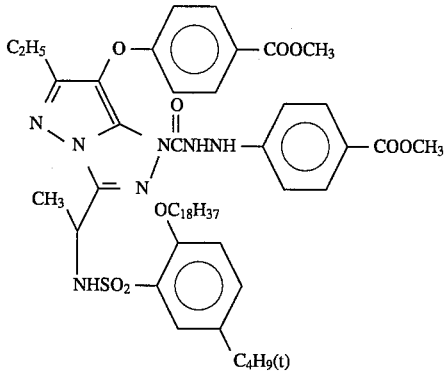
An example of a synthesis method for the hydrazide compound shown by formula (I) is shown by the following synthesis scheme.
Synthesis Scheme
(1)
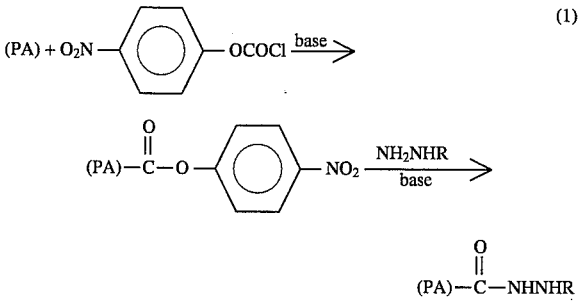
-continued
Synthesis Scheme
(2)
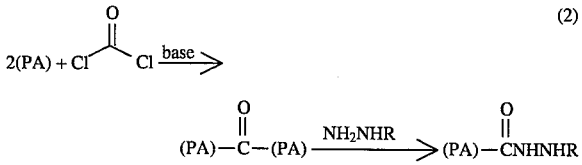
(In the above formulae, R and (PA) have the same meaning as described above.)
A specific synthesis example of a hydrazide compound shown by formula (I) is described below.

Synthesis Example

Synthesis of Compound M-1:

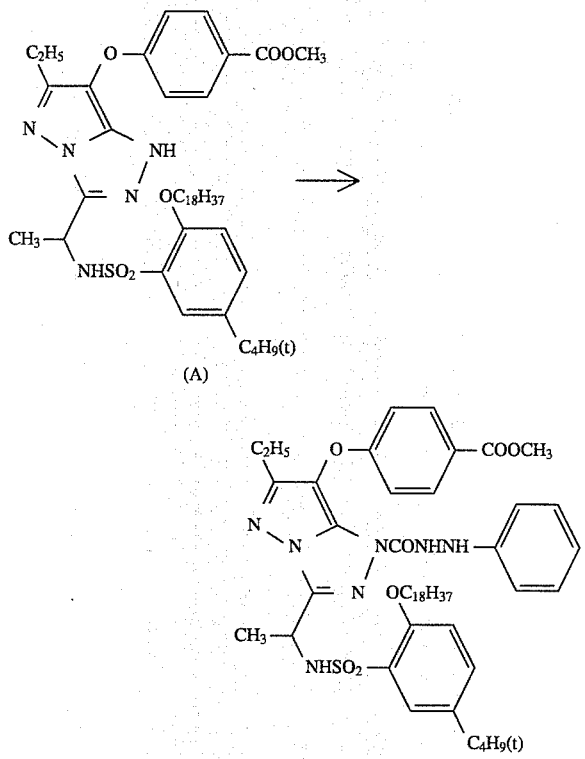

Compound (M-1)

In 100 ml of tetrahydrofuran was dissolved 10 g (12.6 mmols) of Coupler (A), and after adding thereto 1.8 ml (12.9 mmols) of triethylamine, 2.6 g (12.9 mmols) of 4-nitrophenyl chloroformate was added dropwise to the mixture with stirring at room temperature. After stirring the resultant mixture for about 2 hours, 1.4 g (12.9 mmols) of phenylhydrazine was added to the mixture and further 1.8 ml (12.9 mmols) of triethylamine was added dropwise to the mixture. Then, the reaction mixture obtained was extracted with ethyl acetate and the product thus extracted was purified by silica gel column chromatography to provide 9.4 g (yield 80.4%) of Compound (M-1).

The coupler for use in this invention may be present in any layer of the color photographic light-sensitive material, such as a silver halide emulsion layer, a light-insensitive interlayer, etc., and there is no particular restriction on the layer into which the coupler is incorporated. However, it is preferred for the coupler to be present in a green-sensitive silver halide emulsion layer. In particular, in the case of applying the coupler to a color reversal photographic film, the largest effect is obtained when the coupler is present in the silver halide emulsion layer with the highest sensitivity.

There is no particular restriction on the amount of the coupler of formula (I), but the amount is generally from 0.01 mmol/$m^2$ to 1 mmol/$m^2$ of the photographic material.

The color photographic material of the present invention may have at least one blue-sensitive silver halide emulsion layer, at least one green-sensitive silver halide emulsion layer, and at least one red-sensitive silver halide emulsion layer on a support and there are no particular restriction on the number of the silver halide emulsion layers and light-insensitive layers and the disposition of the layers.

A typical example is a silver halide color photographic material having on a support at least one light-sensitive layer composed of plural silver halide emulsion layers each having substantially the same color sensitivity but having a different light sensitivity, this light-sensitive layer being a unit light-sensitive layer having a color sensitivity to one of blue light, green light, and red light, and in a multilayer silver halide color photographic material, the unit red-sensitive light-sensitive layer, the unit green-sensitive light-sensitive layer, and the unit blue-sensitive light-sensitive layer are generally disposed successively on a support in this order. However, according to the purposes, other dispositions of the layers than the above disposition may be employed and also the unit light-sensitive layer composed of light-sensitive layers having the same color sensitivity, a different light-sensitive layer being formed between the foregoing light-sensitive layers can be employed if desired.

Also, various kinds of light-insensitive layers, such as a protective layer, interlayers, etc., may be formed between the foregoing silver halide light-sensitive emulsion layers, or as the uppermost or lowermost layer.

The interlayers may contain the couplers, the DIR compounds, etc., as described in JP-A-61-43748, JP-A-59-113438, JP-A-59-113440, JP-A-61-20037, and JP-A-61-20038 or may contain a color mixing inhibitor conventionally used.

The plural silver halide emulsion layers constituting each unit light-sensitive layer can comprise a two-layer construction composed of a high-speed emulsion layer and a low-speed emulsion layer as described in West German Patent 1,121,479 and British Patent 923,045 which is preferably used. In this case, it is usually preferable for the light-sensitive layers to be disposed such that the light-sensitivity successively decreases towards the support, and also a light-insensitive layer may be formed between each of the silver halide emulsion layers. Furthermore, a low-speed emulsion layer may be disposed at the farthest from the support and a high-speed emulsion layer may be disposed at the closest to the support as described in JP-A-57-112751, JP-A-62-200350, JP-A-62-206541, JP-A-62-206543, etc.

A specific example of a layer structure can be layers disposed in the order of a low-speed blue-sensitive light-sensitive layer (BL)/a high-speed blue-sensitive light-sensitive layer (BH)/a high-speed green-sensitive emulsion layer (GH)/a low-speed green-sensitive light-sensitive layer (GL)/a high-speed red-sensitive light-sensitive layer (RH)/a low-speed red-sensitive light-sensitive layer (RL), or the order of BH/BL/GL/GH/RH/RL, or further the order of BH/BL/GH/GL/RL/RH from the farthest side from the support.

Also, as described in JP-B-55-34932, the layers can be disposed in the order of a blue-sensitive layer/GH/RH/GL/RL from the side farthest from the support. Furthermore, as described in JP-A-56-25738 and JP-A-62-63936, the layers may be disposed in the order of a blue-sensitive layer/GL/RL/GH/RH from the side farthest from the support.

Also, the structure of three layers each having a different sensitivity can comprise a silver halide emulsion layer having the highest light sensitivity as an upper layer, a silver halide emulsion layer having a light sensitivity lower than the upper emulsion layer as an intermediate layer, and a silver halide emulsion layer having a light sensitivity lower than the intermediate layer, these three layers being disposed such that the light sensitivity successively decreases toward the support, as described in JP-B-49-15495. In the case of such a structure of three layers each having a different light sensitivity, the layers may be disposed in a same color-sensitive layer in the order of an intermediate-speed emulsion layer/a high-speed emulsion layer/a low-speed emulsion layer from the side farthest from the support as described in JP-A-59-202464.

In other examples, the layers may be disposed in the order of a high-speed emulsion layer/a low-speed emulsion layer/an intermediate-speed emulsion layer or in the order of a low-speed emulsion layer/an intermediate-emulsion layer/a high-speed emulsion layer. Also, when the unit light-sensitive layer comprises 4 or more emulsion layers each having a different light sensitivity, the disposition of the layers may be changed as described above.

For improving the color reproducibility, it is preferred that a donor layer (CL) for giving an interlayer effect having a different spectral sensitivity distribution than the main light-sensitive layers such as BL, GL, RL, etc., is disposed adjacent to or near the main light-sensitive layer as described in U.S. Pat. Nos. 4,663,271, 4,705,744, and 4,707,436, JP-A-62-160448, and JP-A-63-89850.

As described above, various layer structures and layer dispositions can be selected depending on the purpose of each color photographic light-sensitive material.

A preferred silver halide contained in the silver halide emulsion layers of the color photographic material of the present invention is silver iodobromide, silver iodochloride, or silver iodochlorobromide each containing not more than about 30 mol % silver iodide. A particularly preferred silver halide is silver iodobromide or silver iodochloride containing from about 2 mol % to about 10 mol % silver iodide.

The silver halide grains in the silver halide photographic emulsions for use in the present invention may have a regular crystal form such as cubic, octahedral, tetradecahedral, etc., an irregular crystal form such as spherical, tabular, etc., a form having a crystal defect such as a twin plane, or a composite of these forms.

The grain sizes of the silver halide grains may be fine as less than about 0.2 μm or large as about 10 μm in projected area diameter. Also, the silver halide emulsion for use in this invention may be a polydisperse emulsion or a monodisperse emulsion.

The silver halide photographic emulsions for use in the present invention can be prepared using the methods described in *Research Disclosure* (RD), No. 17643 (December, 1978), pages 22–23, "Emulsion Preparation and Type", *ibid.*, No. 18716 (November 1979), page 648, *ibid.*, No. 307105 (November, 1989), P. Glafkides, *Chemie et Phisique Photographique*, (published by Paul Montel, 1967, G. F. Duffin, *Photographic Emulsion Chemistry*, (Focal Press, 1966), and V. L. Zelikman et al., *Making and Coating Photographic Emulsion*, (Focal Press, 1964).

The monodisperse emulsions described in U.S. Pat. Nos. 3,574,628 and 3,655,394 and British Patent 1,413,748 are also preferable.

Also, tabular silver halide grains having an aspect ratio of at least about 3 can be used in the present invention. The tabular silver halide grains can be simply prepared by the methods described in Gutoff, *Photographic Science and Engineering*, Vol. 14, 248–257(1970), U.S. Pat. Nos. 4,434,226, 4,414,310, 4,433,048, and 4,439,520 and British Patent 2,112,157.

The crystal structure of the silver halide grains may be uniform throughout the grain or a different halide composition between the inside and the surface portion may exist. Also, the crystal structure may have a layer structure, a structure junctioned to a silver halide having a different composition at an epitaxial junction, or a structure junctioned to another compound than silver halide, such as silver rhodanate, lead oxide, etc. Furthermore, a mixture of silver halide grains having various crystal forms can be used.

The silver halide emulsion for use in the present invention may be of a surface latent image type forming a latent image mainly on the surface of the silver halide grains or of an internal latent image type forming an image mainly in the inside of the silver halide grains, but such must be a negative-working silver halide emulsion. The internal latent image-type emulsion may be a core/shell type internal latent image emulsion as described in JP-A-63-264740. The preparation method of the core/shell type internal latent image emulsion is described, e.g., in JP-A-59-133542. The thickness of the shell of the core/shell type internal latent image emulsion differs depending on the manner of development processing, etc., but is preferably from 3 to 40 nm., and particularly preferably from 5 to 20 nm.

The silver halide emulsion is physically ripened, chemically ripened, and spectrally sensitized for use. Suitable additives used in these steps are described in *Research Disclosure* Nos. 17643, 18716, and 307105 and the corresponding portions are summerired in the table shown below.

Two or more kinds of silver halide emulsions each having at least one different property of grain sizes, grain size distribution, halogen composition, form of the silver halide grains, and sensitivity as a mixture thereof in the same emulsion layer can be employed in the color photographic light-sensitive material of the present invention.

The grain surface-fogged silver halide grains described in U.S. Pat. No. 4,082,553 or the grain interior fogged silver halide grains described in U.S. Pat. No. 5,626,498 and JP-A-59-214852 can be advantageously used for the light-sensitive silver halide emulsion layer(s) and/or the substantially light-insensitive hydrophilic colloid layer(s) of the color photographic light-sensitive material of the present invention.

The grain interior—or grain surface-fogged silver halide grains mean the silver halide grains which can be uniformly (non-imagewise) developed regardless of the unexposed portions and the exposed portions of photographic light-sensitive material. Methods of preparing the grain interior—or grain surface-fogged silver halide grains are described in U.S. Pat. No. 4,626,498 and JP-A-59-214852.

The silver halides forming the internal nuclei of the grain interior-fogged core/shell type silver halide grains may have the same halogen composition or have different halogen compositions.

Silver chloride, silver chlorobromide, silver iodobromide, or silver chloroiodobromide can be used as the grain interior—or surface-fogged silver halide. There is no particular restriction on the grain sizes of these fogged silver halide grains but the mean grain size thereof is preferably from 0.01 to 0.75 μm, and particularly preferably from 0.05 to 0.6 μm.

Also, there is no particular restriction on the form of the silver halide grains and the grain form may be regular grains or a polydisperse silver halide emulsion but is preferably a monodisperse silver halide emulsion (i.e., at least 95% of the weight or the grain number of the silver halide grains have grain sizes within ±40% of the mean grain size).

In the present invention, it is preferred to use a light-insensitive fine grain silver halide. The light-insensitive fine grain silver halide is a fine grain silver halide which is not light-exposed at an imagewise exposure for obtaining a dye image and is not substantially developed at the development process and it is preferred that the silver halide is not previously fogged.

The fine grain silver halide has a silver bromide content of from 0 to 100 mol % and may contain, if necessary, silver chloride and/or silver iodide. The fine grain silver halide contains preferably from 0.5 to 10 mol % silver iodide.

The mean grain size (mean value of diameters corresponding to the circles of the projected areas) of the fine grain silver halide is preferably from 0.01 to 0.5 μm, and more preferably from 0.02 to 0.2 μm.

The fine grain silver halide can be prepared by the method same as the method of producing an ordinary light-sensitive silver halide. In this case, the surface of the silver halide grains does not need to be chemically sensitized and does not need be spectrally sensitized. However, it is preferred that before adding the fine grain silver halide to a coating composition, a known stabilizer such as a triazole series compound, an azaindene series compound, a benzothiazolium compound, a mercapto series compound, a zinc compound, etc., is previously added to the fine grain silver halide.

The silver coverage (coating amount) of the color photographic material of the present invention is preferably not more than 6.0 g/m$^2$, and most preferably not more than 4.5 g/m$^2$.

Known photographic additives which can be used in the present invention are also described in the following *Research Disclosures* and the corresponding portions are shown in the following table.

| Kind of Additives | RD 17643 | RD 18716 | RD 307105 |
|---|---|---|---|
| 1. Chemical Sensitizer | p. 23 | p. 648, right col. | p. 866 |
| 2. Sensitivity Improving Agent | — | p. 648, right col. | — |
| 3. Spectral Sensitizer & Super Sensitizer | pp. 23 to 24 | p. 648, right col. to p. 649, right col. | pp. 866 to 868 |
| 4. Whitening Agent | p. 24 | p. 649, right col. | p. 868 |
| 5. Antifoggant & Stabilizer | pp. 24 to 25 | p. 649, right col. | pp. 868 to 870 |
| 6. Light Absorber, Filter, Dye & UV Absorber | pp. 25 to 26 | p. 649, right col. to p. 650, left col. | p. 873 |
| 7. Stain Inhibitor | p. 25, right col. | p. 650, left to right cols. | p. 872 |
| 8. Dye Image Stabilizer | p. 25, right col. | p. 650, left col. to right col. | p. 872 |
| 9. Hardening Agent | p. 26 | p. 651, left col. | pp. 874 to 875 |
| 10. Binder | p. 26 | p. 651 left col. | pp. 873 to 874 |
| 11. Plasticizer & Lubricant | p. 27 | p. 650, right col. | p. 876 |
| 12. Coating Aid & Surface Active Agent | pp. 26 to 27 | p. 650, right col. | pp. 875 to 876 |
| 13. Antistatic Agent | p. 27 | p. 650, right col. | pp. 876 to 877 |
| 14. Matting Agent | — | — | pp. 878 to 879 |

Also, to prevent a deterioration in photographic performance due to formaldehyde gas, it is preferred that a compound capable of fixing formaldehyde by reaction with it is added to the color photographic light-sensitive material of the present invention as described in U.S. Pat. Nos. 4,411,987 and 4,435,503.

Furthermore, it is preferred that the mercapto compounds described in U.S. Pat. Nos. 4,740,454 and 4,788,132, JP-A-62-18539 and JP-A-1-283551 are incorporated in the color photographic light-sensitive materials of the present invention.

Also, it is preferred that the fogging agent, the development accelerator, the silver halide solvent or the precursors thereof described in JP-A-1-106052 are incorporated in the color photographic material of the present invention regardless of the amount of developed silver formed by development processing.

It is also preferred that the dyes dispersed by the methods described in WO (PCT) 88/04794 and WO (PCT) 1 -502912 and the dyes described in EP (European Patent Publication) 317,308A, U.S. Pat. No. 4,420,555, and JP-A-1 -259358 be incorporated in the color photographic materials of the present invention.

For the color photographic materials of the present invention, various kinds of color couplers can be used together with the hydrazide compounds shown by formula (1) described above and specific examples of the color couplers are described in the patents described in *Research Disclosure*, No. 17643, VII-C to G and *ibid.*, No. 307105, VII-C to G.

Preferred yellow couplers are described, e.g., in U.S. Pat. Nos. 3,933,501, 4,022,620, 4,326,024, 4,401,752, 4,248,961, 3,973,968, 4,314,023, and 4,511,649, JP-B-58 -10739, British Patents 1,425,020 and 1,476,760, and European Patent Publication 249,473A.

5-Pyrazolone series compounds and pyrazoloazole series compounds are preferred as magenta couplers and they are described in U.S. Pat. Nos. 4,310,432, 4,351,897, 3,061,432, and 3,725,067, European Patent 73,636, *Research Disclosure*, No. 24220 (June, 1984), *ibid.*, No. 24230 (June, 984), JP-A-60-33552, JP-A-60-43659, JP-A-61-72238, JP-A-60-35730, JP-A-55-118034, and JP-A-60-185951, U.S. Pat. Nos. 4,500,630, 4,540,654, and 4,556,630, WO(PCT) 88/04795, etc.

Phenol series couplers and naphthol series couplers are suitable as cyan couplers, and preferred examples of the couplers are described in U.S. Pat. Nos. 4,052,212, 4,146,396, 4,228,233, 4,296,200, 2,369,929, 2,801,171, 2,772,162, 2,895,826, 3,772,002, 3,758,308, 4,334,011, 4,327,173, 3,446,622, 4,333,999, 4,775,616, 4,451,559, 4,427,767, 4,690,889, 4,254,212, and 4,296,199, West German Patent Publication (OLS) 3,329,729, European Patent Publications 121,365A and 249,453A, JP-A-61-42658, etc. Furthermore, the pyrazoloazole series couplers described in JP-A-64-553, JP-A-64-554, JP-A-64-555, and JP-A-64-556 and the imidazole series couplers described in U.S. Pat. No. 4,818,672 can be used as cyan couplers.

Polymerized dye-forming couplers can be used in the present invention and examples of suitable polymerized dye-forming couplers are described in U.S. Pat. Nos. 3,451,820, 4,080,211, 4,267,282, 4,409,320, and 4,576,910, British Patent 2,102,137, European Patent Publication 341,188A, etc.

Couplers each forming a colored dye having an appropriate diffusibility can be used in the present invention and examples of such couplers are described in U.S. Pat. No. 4,366,237, British Patent 2.125,570, European Patent 96,570, and West German Patent Publication (OLS) 3,234,533.

Also, colored couplers for correcting unnecessary absorption of the colored dyes can be used in the present invention and preferred examples of these colored couplers are described in *Research Disclosure*, No. 17643, VII-G, *ibid.*, No. 307105, VII-G, U.S. Pat. Nos. 4,163,670, 4,004,929, and 4,138,258, JP-B-57-39413, and British Patent 1,146,368. Furthermore, couplers for correcting unnecessary absorption of the colored dye with fluorescent dyes released at coupling described in U.S. Pat. No. 4,774,181 and couplers having, as a releasing group, a dye precursor capable of forming a dye by reacting with a color developing agent described in U.S. Pat. No. 4,777,120 can be advantageously used in the present invention.

Compounds releasing photographic useful residues on coupling can be also used in the present invention.

That is, preferred DIR couplers releasing a development inhibitor are described in the patents described in *Research Disclosure*, No. 17643, VII-F and *ibid.*, No. 307105, VII-F, JP-A-57-151944, JP-A-57-154234, JP-A-60-184248, JP-A-63-37346, and JP-A-63-37350, U.S. Pat. Nos. 4,248,962 and 4,782,012.

Couplers releasing a bleach accelerator described, e.g., in *Research Disclosure*, No. 11449, *ibid.*, No. 24241, and JP-A-61-201247 are effective for shortening the processing time of the processing step having a bleaching faculty and the effect thereof is particularly large where the coupler is added to the color photographic material using the foregoing tabular silver halide grains.

Couplers imagewise releasing a nucleating agent or development accelerator at development can be also used in the present invention and preferred examples of these couplers are described in British Patents 2,097,140 and 2,131,188, JP-A-59-157638 and JP-A-59-170840. Also, the compounds releasing a fogging agent, a development accelerator, a silver halide solvent, etc., respectively, by an oxidation reduction reaction with the oxidation product of a color developing agent described in JP-A-60 -107029, JP-A-60-252340, JP-A-1-44940, and JP-A-1-45687 can be advantageously used in the present invention.

Other couplers which can be used in the present invention include the competing couplers described in U.S. Pat. No. 4,130,427, the poly-equivalent couplers described in U.S. Pat. Nos. 4,283,472, 4,388,393, and 4,310,618, the DIR redox compound-releasing couplers, DIR coupler-releasing couplers, DIR coupler-releasing redox compounds, and DIR redox-releasing redox compounds described in JP-A-60-185950 and JP-A-62-24252, the couplers releasing a dye which is recolored after being released described in European Patent Publications 173,302A and 313,308A, the ligand-releasing couplers described in U.S. Pat. No. 4,555,477, the couplers releasing a leuco dye described in JP-A-63-75747, and the couplers releasing a fluorescent dye described in U.S. Pat. No. 4,774,181.

The couplers used in the present invention can be introduced into the color photographic material using various known dispersion methods.

For example, the couplers can be introduced into the color photographic material by an oil drop-in-water dispersion method. Examples of suitable high-boiling organic solvents which can be used for the oil drop-in-water dispersion method are described in U.S. Pat. No. 2,322,027.

Specific examples of high-boiling organic solvents having a boiling point of at least 175° C. at normal pressure, which can be used for the oil drop-in-water dispersion method are phthalic acid esters (e.g., dibutyl phthalate, dicyclohexylphthalate, di-2-ethylhexyl phthalate, decyl phthalate, bis(2,4-di-t-amylphenyl)phthalate, bis(2,4-di-t-amylphenyl-)isophthalate, and bis(1,1-diethylpropyl)phthalate), phosphoric acid esters and phosphonic acid esters (e.g., triphenyl phosphate, tricresyl phosphate, 2-ethylhexyl diphenylphosphate, tricyclohexyl phosphate, tri-2-ethylhexyl phosphate, tridodecyl phosphate, tributoxyethyl phosphate, tri-chloropropyl phosphate, and di-2-ethylhexylphenyl phosphonate), benzoic acid esters (e.g., 2-ethylhexyl benzoate, dodecyl benzoate, and 2-ethylhexyl p-hydroxybenzoate), amides (e.g., N,N-diethyldodecanamide, N,N-diethyllaurylamide, and N-tetradecylpyrrolidone), alcohols and phenols (e.g., isostearyl alcohol and 2,4-di-tertamylphenol), aliphatic carboxylic acid esters (e.g., bis(2-ethylhexyl)sebacate, dioctyl azelate, glycerol tributyrate, isostearyl lactate, and trioctyl citrate), aniline derivatives (e.g., N,N-dibutyl-2-butoxy-5-tertoctylaniline), and hydrocarbons (e.g., paraffin, dodecylbenzene, and diisoprpylnaphthalene).

Also, the foregoing high-boiling organic solvents can be used together with an organic solvent having a boiling point of from about 30° C., and preferably from 50° C., to about 160° C. as an auxiliary solvent and examples of these auxiliary solvents are ethyl acetate, butyl acetate, ethyl propionate, methyl ethyl ketone, cyclohexanone, 2-ethoxyethyl acetate, and dimethylformamide.

Moreover, the couplers can be introduced into the color photographic material of the present invention using a latex dispersion method and the latex dispersion method and latexes for the dispersion method are described in U.S. Pat. No. 4,199,363, West German Patent Publications (OLS) 2,541,274 and 2,541,130.

It is preferred that the color photographic light-sensitive materials of the present invention contain various kinds of antiseptics or antifungal agents, such as 1,2-benzisothiazolin-3-one, n-butyl p-hydroxybenzoate, phenol, 4-chloro-3,5-dimethylphenol, 2-phenoxy ethanol, 2 -(4-thiazolyl)benzimidazole, etc., described in JP-A-63-257747, JP-A-62-272248, and JP-A-1-80941, and phenethyl alcohol.

Supports which are suitably used in the present invention are described, e.g., in *Research Disclosure*, No. 17643, page 28, *ibid.*, No. 18716, from page 647, right column to page 648, left column, and *ibid.*, No. 307105, page 879.

The sum total of the layer thicknesses of the total hydrophilic colloid layers on the side having the silver halide emulsion layers in the color photographic material of the present invention is preferably not thicker than 28 μm, more preferably not thicker than 23 μm, even more preferably not thicker than 18 μm, and particularly preferably not thicker than 16 μm. Also, a film swelling rate $T_{1/2}$ is preferably not higher than 30 seconds, and more preferably not higher than 20 seconds.

The layer thickness means the layer thickness measured at a temperature of 25° C. and a relative humidity of 55% (2 days) and the film swelling rate $T_{1/2}$ can be measured in a manner well known in the field of the art. For example, the film swelling speed can be measured by using a swellometer of the type described in A. Green et al, *Photographic Science and engineering*, Vol. 19, No. 2, pages 124 to 129 and the film swelling rate $T_{1/2}$ is defined as the time required until swelling reaches ½ of a saturated swollen film thickness which is defined as 90% of the maximum swollen thickness attained when the color photographic light-sensitive material is processed with a color developer at 30° C. for 3 minutes and 15 seconds.

The film swelling speed $T_{1/2}$ can be controlled by adding a hardening agent to gelatin as the binder or by changing the aging condition after coating.

Also, in the present invention, the swelling ratio is preferably from 150 to 400%. The swelling ratio can be calculated by the following equation:

Swelling ratio=$(A-B)/B$

A: Maximum swollen film thickness under the condition described above.

B. Total film thickness.

In the color photographic light-sensitive material of the present invention, it is preferred to form a hydrophilic colloid layer (back layer) having a total dry thickness of from 2 μm to 20 μm on the support on the opposite side to the side having the silver halide emulsion layers. It is preferred that the back layer contains a light absorber, a filter dye, an ultraviolet absorber, an antistatic agent, a hardening agent, a binder, a plasticizer, a lubricant, a coating aid, a surface active agent, etc. The swelling ratio of the back layer is preferably from 150 to 500%.

A color developer which can be used for developing the color photographic light-sensitive material of the present invention is an alkaline aqueous solution containing, preferably, an aromatic primary amine color developing agent as the main component.

Aminophenol series compounds can be used as the color developing agent but p-phenylenediamine series compounds can be advantageously used. Specific examples thereof are 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-β-methoxyethylaniline, 4-amino-3-methyl-N-methyl-N-( 3-hydroxypropyl)aniline, 4-amino-3-methyl-N-ethyl-N-( 3-hydroxypropyl)aniline, 4-amino-3-methyl-N-ethyl-N-( 2-hydroxypropyl)aniline, 4-amino-3-ethyl-N-ethyl-N-( 3-hydroxypropyl)aniline, 4-amino-3-methyl-N-propyl-N-( 3-hydroxypropyl)aniline, 4-amino-3-propyl-N-methyl-N-( 3-hydroxypropyl)aniline, 4-amino-3-methyl-N-methyl-N-( 4-hydroxybutyl)aniline, 4-amino-3-methyl-N-ethyl-N-( 4-hydroxybutyl)aniline, 4-amino-3-methyl-N-propyl-N-( 4-hydroxybutyl)aniline, 4-amino-3-ethyl-N-ethyl-N-( 3-hydroxy-2-methylpropyl)aniline, 4-amino-3-methyl-N,N-bis(4-hydroxybutyl)aniline, 4-amino-3-methyl-N,N-bis( 5-hydroxypentyl)aniline, 4-amino-3-methyl-N-(5-hydroxypentyl)-N-(4-hydroxybutyl)aniline, 4-amino-3-methoxy-N-ethyl-N-(4-hydroxybutyl)aniline, 4-amino-3-ethoxy-N,N-bis(5-hydroxypentyl)aniline, 4-amino-3-propyl-N-( 4-hydroxybutyl)aniline, and the sulfates, hydrochlorides, and p-toluenesulfonates of them.

Of these compounds, 3-methyl-4-amino-N-ethyl-N-β-hydroxyethylaniline, 4-amino-3-methyl-N-ethyl-N-(3-hydroxypropyl)aniline, 4-amino-3-methyl-N-ethyl-N-(4-hydroxybutyl)aniline, and the hydrochlorides, p-toluenesulfonates, and the sulfates thereof are preferred. These compounds may be used alone or as a mixture thereof depending on the purpose.

The color developer generally contains a pH buffer such as the carbonate, borate, or phosphate of an alkali metal and a development inhibitor or an antifoggant, such as a chloride, a bromide, an iodide, a benzimidazole, a benzothiazole, and a mercapto compound.

Also, if desired, the color developer may further contain a preservative such as hydroxylamine, diethyl hydroxylamine, sulfites, hydrazines (e.g., N,N-biscarboxymethylhydrazine), phenylsemicarbazides, triethanolamine, catecholsulfonic acid, etc.; an organic solvent such as ethylene glycol, diethylene glycol, etc.; a development accelerator such as benzyl alcohol, polyethylene glycol, quaternary ammonium salts, amines, etc.; a dye-forming coupler; a competing coupler; an auxiliary developing agent such as 1-phenyl-3-pyrazolidone, etc.; a tackifier; a chelating agent such as aminopolycarboxylic acids, aminopolyphosphonic acids, alkylphosphonic acids, and phosphonocarboxylic acids (e.g., ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N,N-tetramethylenephosphonic acid, ethylenediamine-di(o-hydroxyphenylacetic acid), and the salts thereof).

Other processing solutions for the color reversal photographic light-sensitive material of the present invention than the color developer and the processing steps are explained below.

In the processing of the color reversal photographic light-sensitive material of the present invention, the steps from black and white development to color development are as follows.

1) Black and white development—wash—reversal—color development.

2) Black and white development—wash—light reversal—color development.

3) Black and white development—wash—color development.

In place of the wash step in 1) to 3) described above, the rinse step described in U.S. Pat. No. 4,804,616 can be used for simplifying the processing steps and reducing the amount of a waste liquid.

The steps after the color development are shown below.

4) Color development—control—bleach—fix—wash—stabilization.

5) Color development—wash—bleach—fix—wash—stabilization.

6) Color development—control—bleach—wash—fix—wash—stabilization.

7) Color development—wash—bleach—wash—fix—wash—stabilization.

8) Color development—bleach—fix—wash— stabilization.

9) Color development—bleach—bleach—fix (blix)—wash—stabilization.

10) Color development—bleach—blix—fix—wash—stabilization.

11) Color development—bleach—wash—fix—wash—stabilization.

12) Color development—control—blix—wash—stabilization.

13) Color development—wash—blix—wash—stabilization.

14) Color development—blix—wash—stabilization.

15) Color development—fix—blix—wash—stabilization.

In processings 4) to 15), the washing step directly before the stabilization step may be omitted and, also, the stabilization step as the final step may be omitted.

The color reversal processing is achieved by combining one of the foregoing 1) to 3) and one of 4) to 15).

Then, the processing solutions for the color reversal processing steps for processing the color photographic material of the present invention are explained below.

A known developing agent can be used for the black and white developer being used for developing the color photographic material of the present invention.

Dihydroxybenzenes (e.g., hydroquinone), 3-pyrazolidones (e.g., 1-phenyl-3-pyrazolidone), aminophenols (e.g., N-methyl-p-aminophenol), 1-phenyl-3-pyrazolines, ascorbic acid, and the heterocyclic compound obtained by condensing a 1,2,3,4-tetrahydroquinoline ring and an indolene ring described in U.S. Pat. No. 4,067,872 can be used alone or as a combination thereof as the color developing agent.

The black and white developer used in the present invention can further contain, if desired, a preservative (e.g., sulfites and bisulfites), a buffer (e.g., carbonates, boric acid, borates, and alkanolamine), an alkali agent (e.g., hydroxides and carbonates), a dissolution aid (e.g., polyethylene glycols and the esters thereof), a pH controlling agent (e.g., organic acids such as acetic acid), a sensitizer (e.g., quaternary ammonium salts), a development accelerator, a surface active agent, a defoaming agent, a hardening agent, a tackifier, etc.

The black and white developer used in the present invention should contain a compound acting as a silver halide solvent but usually a sulfite added as the foregoing preservative also acts as the silver halide solvent. Specific examples of the sulfite and other silver halide solvents are KSCN, NaSCN, $K_2SO_3$, $Na_2SO_3$, $K_2S_2O_5$, $Na_2S_2O_5$, $K_2S_2O_3$, $K_2S_2O_3$, $Na_2S_2O_3$, etc.

The pH of the developer thus prepared is selected such that a desired density and contrast of images formed is achieved and it is usually in the range of from about 8.5 to about 11.5.

For carrying out sensitizing processing using such a black and white developer, the processing time may be prolonged to at most about three times the processing time for standard processing. In this case, when the processing time is increased, the processing time for sensitizing processing can be shortened.

The pH of the color developer and the black and white developer is generally from 8 to 12.

The replenishing amounts for these developers are generally not more than 3 liters per square meter of the color photographic material although the amounts differ depending on the kind of the color photographic material being processed and the replenishing amount can be reduced below 500 ml by reducing the bromide ion concentration in the replenisher. Where the replenishing amount is reduced, it is preferred to prevent the occurrence of the evaporation and the air oxidation of the solution by reducing contact area of the developer in the bath with air.

The contact area of the photographic processing solution in a processing bath with air can be represented by the opening ratio defined below.

$$\text{Opening ratio}=C(cm^2)/D(cm^3)$$

C: Contact area of the processing solution with air

D: Volume of the processing solution

The foregoing opening ratio is preferably not more than 0.1, and more preferably from 0.001 to 0.05. Methods for reducing the opening ratio as described above include a method of placing a shielding material such as a floating lid, etc., on the surface of the photographic processing solution in the processing bath, a method of using a movable lid described in JP-A-1-82033, and a the slit developing method described in JP-A-63-216050.

A reduction in the opening ratio is preferably applied not only to both the steps of color development and black and white development but also to all other steps such as, for example, a bleach step, a blix step, a fix step, a wash step, a stabilization step, etc. Also, the replenishing amount can be reduced by using a means of restraining the accumulation of bromide ion in the developer.

The reversal bath used after the black and white development can contain a known fogging agent. Suitable fogging agents are, for example, stannous ion complex salts such as the stannous ion-organic phosphoric acid complex salt described in U.S. Pat. No. 3,617,282, the stannous ion-organic phosphonocarboxylic acid complex salt described in JP-B-56-32166, the stannous ion-aminopolycarboxylic acid complex salt described in U.S. Pat. No. 1,209,050, etc., and the boron hydride compounds described in U.S. Pat. No. 2,984,567, the heterocyclic amineborane compounds described in British Patent 1,011,000. The pH of the fogging bath (reversal bath) is in a wide range from acidic to alkaline, i.e., is in the range of from 2 to 12, preferably from 2.5 to 10, and more preferably from 3 to 9.

In place of using the reversal bath, light reversal processing by a re-exposure may be employed and also by adding the fogging agent to the color developer, the reversal step can be omitted.

The silver halide color photographic material of the present invention is bleached or bleach-fixed (blixed) after color development. The bleaching process or the blixing process may be carried out immediately after color development without employing other processing step(s) or may be carried out through the processing steps of stop, control, wash, etc., after color development for reducing the amount of the color developer carried into the desilvering step or washing out the sensitizing dyes, dyes, etc., present in the color photographic material and the color developing agent present in the color photographic material.

After color development, the silver halide photographic emulsion layers are usually bleached. The bleaching process may be simultaneously carried out with the fixing process (bleach-fix or blix process) or may be carried out separately from the fixing process. Furthermore, for shortening the processing time, a processing method wherein the blixing process is carried out after the bleaching process may be employed. Still further, a step of processing with two blix baths connected to each other, a step of fixing before the blixing process, or a step of bleaching after the blixing process can be optionally practiced depending on the purpose. Compounds of a polyvalent metal such as iron(III), peracids, quinones, nitro compounds, etc., are used as the bleaching agent.

Typical bleaching agents are organic complex salts of iron(III) and examples thereof are iron(III) complex salts of aminopolycarboxylic acids such as ethylenediaminetetraacetic acid, diethylenetriaminepentaacetic acid, cyclohexanediaminetetraacetic acid, methyliminodiacetic acid, 1,3-diaminopropanetetraacetic acid, glycol ether diaminetetraacetic acid, etc., or citric acid, tartaric acid, malic acid, etc. Of these complex salts, the aminopolycarboxylic acid iron(III) complex salts such as ethylenediaminetetraacetic acid iron(III) complex salt and 1,3-diaminopropanetetraacetic acid iron(III) complex salt are preferred from the view points of quick processing and prevention of the occurrence of environmental pollution. Furthermore, the aminopolycarboxylic acid iron(III) complex salt is particularly useful in the bleaching solution and the blixing solution.

The pH of the bleaching solution or the blixing solution using the aminopolycarboxylic acid iron(III) complex salt is usually from 4.0 to 8 but a lower pH can be employed for shortening the processing time.

For the bleaching solution, the blixing solution and the pre-bath thereof, if desired, a bleach accelerators can be used. Specific examples of useful bleach accelerators are the compounds having a mercapto group or a di-sulfide group described in West German Patents 1,290,812 and 2,059,988, JP-A-53-32736, JP-A-53-57831, JP-A-53-37418, JP-A-53-

72623, JP-A-53-95630, JP-A-53-95631, JP-A-53-104232, JP-A-53-124424, JP-A-141623, and JP-A-53-28426, *Research Disclosure*, No. 17129 (July, 1978), etc.; the thiazolidine derivatives described in JP-A-50-140129; the thiourea derivatives described in JP-B-45-8506, JP-A-52-20832, JP-A-53-32735, U.S. Pat. No. 3,706,561, etc.; the iodides described in West German Patent 1,127,715, JP-A-58-16235, etc.; the polyoxyethylene compounds described in West German Patents 966,410, 2,748,430, etc.; the polyamine compounds described in JP-B-45-8836, etc.; the compounds described in JP-A-49-40943, JP-A-49-59644, JP-A-53-94927, JP-A-54-35727, JP-A-55-26506, JP-58-163940, etc.; and bromide ions. Of these compounds, the compounds having a mercapto group or a disulfide group are preferred in the view point of showing a large accelerating effect and the compounds described in U.S. Pat. No. 3,898,858, West German Patent 1,290,812, and JP-A-53-95630 are particularly preferred. Furthermore, the compounds described in U.S. Pat. No. 4,552,834 are preferred.

The bleach accelerator may be incorporated in the color photographic light-sensitive material. The bleach accelerator is particularly useful in the case of blixing the color photographic light-sensitive material for in-camera use.

It is preferred that the bleaching solution or the blixing solution contains an organic acid in addition to the foregoing compounds to prevent the occurrence of bleach stains. A particularly preferred organic acid is a compound having an acid dissociation constant (pKa) of from 2 to 5 and specifically acetic acid, propionic acid, hydroxyacetic acid, etc., are preferred.

Examples of fixing agent which can be used for the fixing solution and the blixing solution are thiosulfates, thiocyanates, thioether series compounds, thioureas, a large amount of an iodide, etc., but thiosulfates are usually used and ammonium thiosulfate is most widely used. Also, the use of a thiosulfate together with a thiocyanate, a thioether series compound, or a thiourea is advantageous.

The fixing solution or the blixing solution may further contain a preservative and preferred examples of preservatives are sulfites, bisulfites, carbonyl-bisulfite addition products and the sulfinic acid compounds described in European Patent Publication 294,759A.

Furthermore, it is preferred that the fixing solution or the blixing solution further contain an aminopolycarboxylic acid or an organic sulfonic acid for stabilizing the solution.

The sum of the times for the desilvering steps is preferably short and within the range which does not give inferior desilvering. The processing time for the desilvering steps is preferably from 1 minute to 3 minutes, and more preferably from 1 minute to 2 minutes. Also, the processing temperature for the desilvering steps is from 25° C. to 50° C., and preferably from 35° C. to 45° C. The desilvering rate is increased and the occurrence of stains after processing is effectively prevented in the preferred temperature range.

It is preferred that the solution is stirred as strong as possible in the desilvering steps. Appropriate methods of strengthening stirring are a method striking the surface of the emulsion layer of the color photographic material with the jet stream of the processing solution as described in JP-A-62-183460, a method of increasing the stirring effect by using a rotary means as described in JP-A- 62-183461, a method of increasing the stirring effect by moving the color photographic material while contacting the surface of the emulsion layer thereof with a wiper blade formed in the processing solution to cause turbulent stream at the surface of the emulsion layer, and a method of increasing the amount of the circulating stream of the entire processing solution. Such a stirring improving means is effective for each of the bleaching solution, the blixing solution, and the fixing solution.

It is considered that the improvement of stirring quickens the supply of the bleaching solution, the fixing solution, etc., into the emulsion layers of the color photographic material, and this results in increasing the desilvering rate. Also, the foregoing stirring improving means is more effective in using a bleach accelerator, whereby the bleach accelerating effect can be greatly increased and also a fixing hindering action by the bleach accelerator can be prevented.

It is preferred that an automatic processor which is used for processing the color photographic material of the present invention has means for transporting the color photographic materials being processed as described in JP-A- 60-191257, JP-A-60-191258, and JP-A-60-191259. As described in JP-A-60-191257, such a transporting means can greatly reduce the amount of the processing solution carried into the post bath from the pre-bath and greatly prevents the deterioration of the performance of the processing solution. Such an effect is particularly effective for shortening the processing time in each processing step and reducing the amount of each processing solution needed for replenishing.

The silver halide color photographic material of the present invention is generally subjected to a washing step and/or a stabilization step after desilvering processing.

The amount of wash water in the washing step can be selected over a wide range depending on the properties of the color photographic material (e.g., by using materials such as couplers, etc.), the use of the color photographic material, the temperature of wash water, the number (stage number) of the wash tanks, a replenishing system such as a counter-current system, a normal current system, etc., and other various conditions.

In these conditions, the relationship between the number of wash tanks and the amount of water in a multistage counter-current system can be determined by the method described in *Journal of the Society of Motion Picture and Television Engineers*, Vol. 64, pages 248–253(May, 1955). By the multistage counter-current system described in the foregoing literature, the amount of wash water can be greatly reduced but problems occur in that bacteria grow due to the increase of the residence time of water in the tanks and floats formed attach to the color photographic materials being processed.

In processing of the color photographic materials of the present invention, for solving such a problem, a method of reducing calcium ions and magnesium ions described in JP-A-62-288838 can be very effectively used. Also, the isothiazolone compounds described in JP-A-57-8542; chlorine series bactericides such as thiabendazoles, chlorinated sodium isocyanurate, etc.; benzotriazole; and the bactericides described in Hiroshi Horiguchi, *Bokin Bobai Zai no Kagaku* (*Chemistry of Antibacterial and Antifungal Agents*), published by Sankyo Shuppan K.K., 1986, *Biseibutsu no Mekkin, Sakkin, Bobai Gijutsu* (*Bactericidal and Antifungal Techniques of Microorganisms*), edited by Eisei Gijutsu Kai, published by Kogyo Gijutsu Kai, 1982, and *Bokin Bobaizai Jiten* (*Handbook of Antibacterial and Antifungal Agents*), edited by Nippon Bokin Bobai Gakkai can be used.

The pH of wash water in processing of the color photographic material of the present invention is from 4 to 9, and preferably from 5 to 8. The temperature of wash water and the washing time can be desirably selected depending on the characteristics and the use of the color photographic material being processed but are selected in the ranges of from 15° to 45° C. and from 20 seconds to 10 minutes, and preferably from 25° to 40° C. and from 30 seconds to 5 minutes.

Furthermore, the color photographic material of the present invention can be directly processed by a stabilizing solution in place of using the foregoing wash step. As such a stabilization process, the known methods described in JP-A-57-8543, JP-A-58-14834, and JP-A-60-220345 can be employed.

Also, as the case may be, the color photographic material can be further subjected to a stabilization process after the foregoing washing process. As an example thereof, there is a stabilization bath containing a dye stabilizer and a surface active agent, which is used as the final bath for a color photographic material for in-camera use. Examples of dye stabilizers are aldehydes such as formaldehyde, glutaraldehyde, etc., N-methylol compounds, hexamethylenetetramine, and aldehyde-sulfite addition products. The stabilization bath can also contain a chelating agent and an antifungal agent.

The overflow solution formed by replenishing the replenisher for wash water and/or the stabilization solution described above can be reused in the desilvering steps and other steps.

When the foregoing wash processing solution is concentrated by evaporation in processing using an automatic processor, etc., it is preferred to adjust the concentration of the solution by adding water thereto.

The silver halide color photographic material of the present invention may contain therein a color developing agent for simplifying and shortening processing time. For incorporating a color developing agent in the color photographic material, the use of various precursors of the color developing agent is preferred. Examples of such a precursor are the indoaniline series compounds described in U.S. Pat. No. 3,342,597, the Schiff base type compounds described in U.S. Pat. No. 3,342,599, *Research Disclosure*, No. 14850, and *ibid.*, No. 15159, the aldol compounds described in *Research Disclosure*, No. 13924, the metal complexes described in U.S. Pat. No. 3,719,492, and the urethane series compounds described in JP-A-53-135628.

The silver halide color photographic material of the present invention may also contain various kinds of 1 -phenyl-3-pyrazolidones to accelerate color development. Typical pyrazolidones are described in JP-A-56-64339, JP-A-57-144547, and JP-A-58-115438.

The various processing solutions described above are used at a temperature of from 10° to 50° C. in the present invention. The processing temperature is usually from 33° to 38° C. but a higher temperature can be employed to accelerate processing and to shorten the processing time and, on the contrary, a lower temperature can be employed to improve the image quality of the color images formed and improving the stability of the processing solutions.

The following example is provided to illustrate the present invention but the present invention is not to be construed as being limited thereby in any way. Unless otherwise indicated herein, all parts, percents, ratios and the like are by weight.

EXAMPLE

Preparation of Sample 101:

A multilayer color photographic material with layers of the following compositions on a cellulose triacetate film support of a thickness of 127 μm with subbing layers thereon was prepared as Sample 101. The numerical amounts given are the coated amounts per square meter. In addition, each compound added does not necessarily only provide the effect provided.

| | |
|---|---|
| Layer 1: Antihalation Layer | |
| Black Colloidal Silver | 0.20 g |
| Gelatin | 1.9 g |
| Ultraviolet Absorber U-1 | 0.1 g |
| Ultraviolet Absorber U-3 | 0.04 g |
| Ultraviolet Absorber U-4 | 0.1 g |
| High-Boiling Organic Solvent Oil-1 | 0.1 g |
| Fine Crystal Solid Dispersion of Dye E-1 | 0.1 g |
| Layer 2: Interlayer | |
| Gelatin | 0.40 g |
| Compound Cpd-C | 5 mg |
| Compound Cpd-J | 5 mg |
| Compound Cpd-K | 3 mg |
| High-Boiling Organic Solvent Oil-3 | 0.1 g |
| Dye D-4 | 0.4 mg |
| Layer 3: Interlayer | |
| Surface- and inside-fogged fine grain silver iodobromide emulsion (mean grain size 0.06 μm, variation coeff. 18%, AgI content 1 mol %) | 0.05 g-Ag |
| Gelatin | 0.4 g |
| Layer 4: Low-Speed Red-Sensitive Emulsion Layer | |
| Emulsion A | 0.1 g-Ag |
| Emulsion B | 0.4 g-Ag |
| Gelatin | 0.8 g |
| Coupler C-1 | 0.15 g |
| Coupler C-2 | 0.05 g |
| Coupler C-3 | 0.05 g |
| Coupler C-8 | 0.05 g |
| Compound Cpd-C | 10 mg |
| High-Boiling Organic Solvent Oil-2 | 0.1 g |
| Additive P-1 | 0.1 g |
| Layer 5: Intermediate-Speed Red Sensitive Emulsion Layer | |
| Emulsion B | 0.2 g-Ag |
| Emulsion C | 0.3 g-Ag |
| Gelatin | 0.8 g |
| Coupler C-1 | 0.2 g |
| Coupler C-2 | 0.05 g |
| Coupler C-3 | 0.2 g |
| High-Boiling Organic Solvent Oil-2 | 0.1 g |
| Additive P-1 | 0.1 g |
| Layer 6: High-Speed Red-Sensitive Emulsion Layer | |
| Emulsion D | 0.4 g-Ag |
| Gelatin | 1.1 g |
| Coupler C-1 | 0.3 g |
| Coupler C-2 | 0.1 g |
| Coupler C-3 | 0.7 g |
| Additive P-1 | 0.1 g |
| Layer 7: Interlayer | |
| Gelatin | 0.6 g |
| Additive M-1 | 0.3 g |
| Color Mixing Inhibitor Cpd-1 | 2.6 mg |
| Ultraviolet Absorber U-1 | 0.01 g |
| Ultraviolet Absorber U-2 | 0.002 g |
| Ultraviolet Absorber U-5 | 0.01 g |
| Dye D-1 | 0.02 g |
| Dye D-5 | 0.02 g |
| Compound Cpd-C | 5 mg |
| Compound Cpd-J | 5 mg |
| Compound Cpd-K | 5 mg |
| High-Boiling Organic Solvent Oil-1 | 0.02 g |
| Layer 8: Interlayer | |
| Surface- and inside-fogged silver iodobromide emulsion (mean grain size 0.06 μm, variation coeff. 16%, AgI content 0.3 mol %) | 0.02 g-Ag |
| Gelatin | 1.0 g |
| Additive P-1 | 0.2 g |

-continued

| | |
|---|---|
| Color Mixing Inhibitor Cpd-A | 0.1 g |
| Layer 9: Low-Speed Green-Sensitive Emulsion Layer | |
| Emulsion E | 0.1 g-Ag |
| Emulsion F | 0.2 g-Ag |
| Emulsion G | 0.2 g-Ag |
| Gelatin | 0.5 g |
| Coupler C-4 | 0.1 g |
| Coupler C-7 | 0.2 g |
| Compound Cpd-B | 0.03 g |
| Compound Cpd-C | 10 mg |
| Compound Cpd-D | 0.02 g |
| Compound Cpd-E | 0.02 g |
| Compound Cpd-F | 0.02 g |
| Compound Cpd-G | 0.02 g |
| Compound Cpd-L | 0.05 g |
| High-Boiling Organic Solvent Oil-1 | 0.1 g |
| High-Boiling Organic Solvent Oil-2 | 0.1 g |
| Layer 10: Intermediate-Speed Green-Sensitive Emulsion Layer | |
| Emulsion G | 0.3 g-Ag |
| Emulsion H | 0.1 g-Ag |
| Gelatin | 0.6 g |
| Coupler C-4 | 0.2 g |
| Coupler C-7 | 0.2 g |
| Compound Cpd-B | 0.03 g |
| Compound Cpd-D | 0.02 g |
| Compound Cpd-E | 0.02 g |
| Compound Cpd-F | 0.05 g |
| Compound Cpd-G | 0.05 g |
| Compound Cpd-L | 0.05 g |
| High-Boiling Organic Solvent Oil-2 | 0.01 g |
| Layer 11: High-Speed Green-Sensitive Emulsion Layer | |
| Emulsion I | 0.5 g-Ag |
| Gelatin | 1.0 g |
| Coupler C-4 | 0.3 g |
| Coupler C-7 | 0.2 g |
| Compound Cpd-B | 0.08 g |
| Compound Cpd-C | 5 mg |
| Compound Cpd-D | 0.02 g |
| Compound Cpd-E | 0.02 g |
| Compound Cpd-F | 0.02 g |
| Compound Cpd-G | 0.02 g |
| Compound Cpd-J | 5 mg |
| Compound Cpd-K | 5 mg |
| Compound Cpd-L | 0.05 g |
| High-Boiling Organic Solvent Oil-1 | 0.02 g |
| High-Boiling Organic Solvent Oil-2 | 0.02 g |
| Layer 12: Interlayer | |
| Gelatin | 0.6 g |
| Layer 13: Yellow Filter Layer | |
| Yellow Colloidal Silver | 0.07 g-Ag |
| Gelatin | 1.1 g |
| Color Mixing Inhibitor Cpd-A | 0.01 g |
| High-Boiling Organic Solvent Oil-1 | 0.01 g |
| Fine Crystal Solid Dispersion of Dye E-2 | 0.05 g |
| Layer 14: Interlayer | |
| Gelatin | 0.6 g |
| Layer 15: Low-Speed Blue-Sensitive Emulsion Layer | |
| Emulsion J | 0.2 g-Ag |
| Emulsion K | 0.3 g-Ag |
| Emulsion L | 0.1 g-Ag |
| Gelatin | 0.8 g |
| Coupler C-5 | 0.2 g |
| Coupler C-6 | 0.1 g |
| Coupler C-9 | 0.4 g |
| Layer 16: Intermediate-Speed Blue-Sensitive Emulsion Layer | |
| Emulsion L | 0.1 g-Ag |
| Emulsion M | 0.4 g-Ag |
| Gelatin | 0.9 g |
| Coupler C-5 | 0.3 g |
| Coupler C-6 | 0.1 g |
| Coupler C-9 | 0.1 g |

-continued

| | |
|---|---|
| Layer 17: High-Speed Blue-Sensitive Emulsion Layer | |
| Emulsion N | 0.4 g-Ag |
| Gelatin | 1.2 g |
| Coupler C-5 | 0.1 g |
| Coupler C-6 | 0.1 g |
| Coupler C-9 | 0.6 g |
| High-Boiling Organic Solvent Oil-2 | 0.1 g |
| Layer 18: First Protective Layer | |
| Gelatin | 0.7 g |
| Ultraviolet Absorber U-1 | 0.2 g |
| Ultraviolet Absorber U-2 | 0.05 g |
| Ultraviolet Absorber U-5 | 0.3 g |
| Formalin Scavenger Cpd-H | 0.4 g |
| Dye D-1 | 0.1 g |
| Dye D-2 | 0.05 g |
| Dye D-3 | 0.1 g |
| Layer 19: Second Protective Layer | |
| Colloidal Silver | 0.1 mg-Ag |
| Fine grain silver iodobromide emulsion (mean grain size 0.06 μm, AgI content 1 mol %) | 0.1 g-Ag |
| Gelatin | 0.4 g |
| Layer 20: Third Protective Layer | |
| Gelatin | 0.4 g |
| Polymethyl Methacrylate (mean particle size 1.5 μm) | 0.1 g |
| Copolymer of Methyl Methacrylate and Acrylic Acid at 4:6 by weight (mean particle size 1.5 μm) | 0.1 g |
| Silicone Oil | 0.03 g |
| Surface Active Agent W-1 | 3.0 mg |
| Surface Active Agent W-2 | 0.03 g |

Also, each of the silver halide emulsion layers further contained Additives F-1 to F-8 in addition to the above-described components. Furthermore, each layer described above further contained a Gelatin Hardening Agent H-1 and Surface Active Agents W-3, W-4, W-5, and W-6 for coating and for emulsification.

Furthermore, each layer further contained phenol, 1,2-benzisothiazolin-3-one, 2-phenoxy ethanol, phenethyl alcohol, or p-benzoic acid butyl ester as an antiseptic agent or an antifungal agent.

The silver iodide emulsions used for preparing Sample 101 are shown in Table 1 below.

TABLE 1

| Emulsion | Average Grain Diameter (in terms) of a sphere) (μm) | Coefficient of Variation (%) | AgI Content (%) |
|---|---|---|---|
| A Monodisperse tetra-decahedral grains | 0.28 | 16 | 3.7 |
| B Monodisperse cubic internal latent image type grains | 0.30 | 10 | 3.3 |
| C Monodisperse tabular grains with average aspect ratio of 4.0 | 0.38 | 18 | 5.0 |
| D Monodisperse tabular grains with average aspect ratio of 8.0 | 0.68 | 25 | 2.0 |
| E Monodisperse cubic grains | 0.20 | 17 | 4.0 |
| F Monodisperse cubic grains | 0.23 | 16 | 4.0 |
| G Monodisperse cubic internal latent | 0.28 | 11 | 3.5 |

TABLE 1-continued

| Emulsion | Average Grain Diameter (in terms) of a sphere) (μm) | Coefficient of Variation (%) | AgI Content (%) |
|---|---|---|---|
| image type grains | | | |
| H Monodisperse cubic internal latent image type grains | 0.32 | 9 | 3.5 |
| I Monodisperse tabular grains with average aspect ratio of 9.0 | 0.80 | 28 | 1.5 |
| J Monodisperse tetra-decahedral grains | 0.30 | 18 | 4.0 |
| K Monodisperse tabular grains with average aspect ratio of 7.0 | 0.45 | 17 | 4.0 |
| L Monodisperse cubic internal latent image type grains | 0.46 | 14 | 3.5 |
| M Monodisperse tabular grains with average aspect ratio of 10.0 | 0.55 | 13 | 4.0 |
| N Tabular grains with average aspect ratio of 12.0 | 1.00 | 33 | 1.3 |

The sensitizing dyes used for the foregoing silver halide emulsions A to N are shown in Table 2 below together with the amounts thereof used.

TABLE 2

Spectral Sensitization of Emulsions A to N

| Emulsion | Sensitizing Dye Added | Amount (g) Added per Mol of Silver Halide |
|---|---|---|
| A | S-2 | 0.025 |

TABLE 2-continued

Spectral Sensitization of Emulsions A to N

| Emulsion | Sensitizing Dye Added | Amount (g) Added per Mol of Silver Halide |
|---|---|---|
| | S-3 | 0.25 |
| | S-8 | 0.01 |
| B | S-1 | 0.01 |
| | S-3 | 0.25 |
| | S-8 | 0.01 |
| C | S-1 | 0.01 |
| | S-2 | 0.01 |
| | S-3 | 0.25 |
| | S-8 | 0.01 |
| D | S-2 | 0.01 |
| | S-3 | 0.10 |
| | S-8 | 0.01 |
| E | S-4 | 0.5 |
| | S-5 | 0.1 |
| F | S-4 | 0.3 |
| | S-5 | 0.1 |
| G | S-4 | 0.25 |
| | S-5 | 0.08 |
| | S-9 | 0.05 |
| H | S-4 | 0.2 |
| | S-5 | 0.06 |
| | S-9 | 0.05 |
| I | S-4 | 0.3 |
| | S-5 | 0.07 |
| | S-9 | 0.1 |
| J | S-7 | 0.2 |
| | S-6 | 0.05 |
| K | S-6 | 0.2 |
| | S-5 | 0.05 |
| L | S-6 | 0.22 |
| | S-5 | 0.06 |
| M | S-6 | 0.15 |
| | S-5 | 0.04 |
| N | S-6 | 0.22 |
| | S-5 | 0.06 |

The compounds used for preparing Sample 101 are shown below together with the sensitizing dyes in Table 1.

C-1

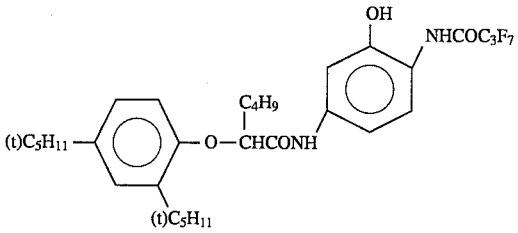

C-2

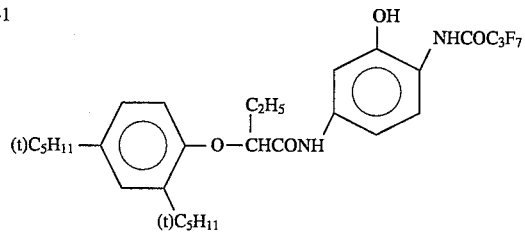

C-3

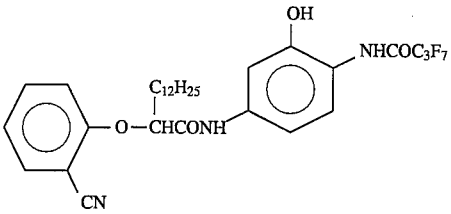

C-4

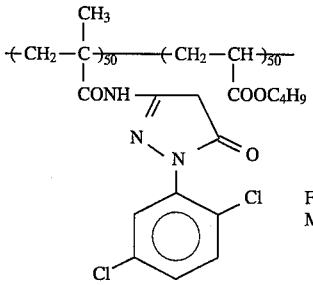

Figure indicates wt %
Mean Molecular Weight: about 25,000

-continued
C-5
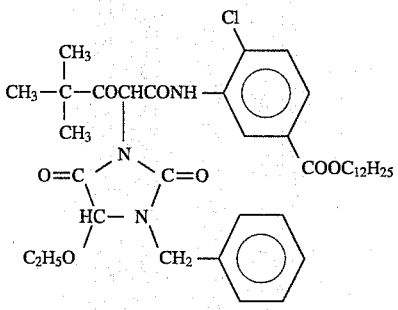
C-6
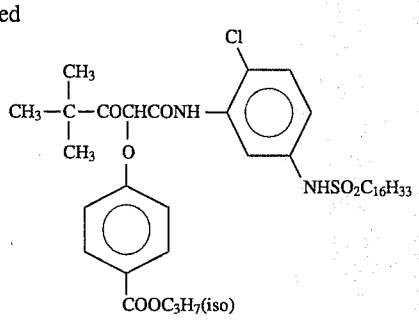
C-7
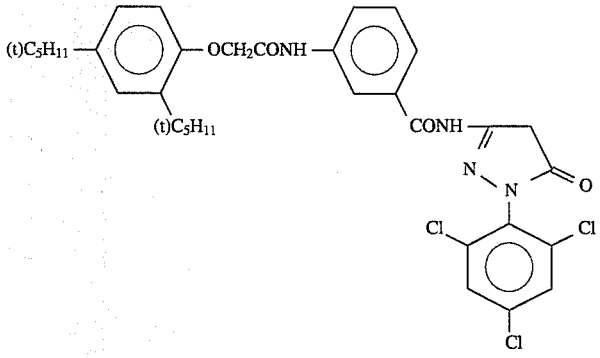
C-8
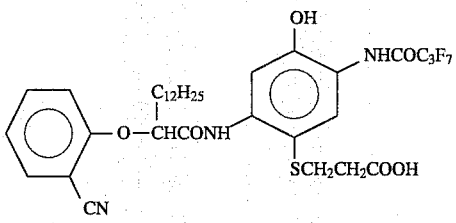
C-9
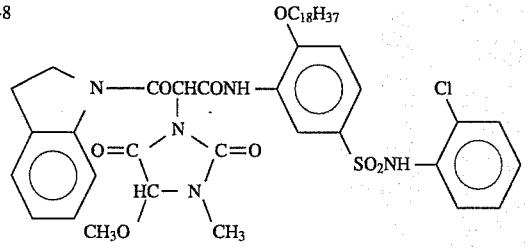
Dibutyl Phthalate Oil-1
Tricresyl Phosphate Oil-2
Oil-3
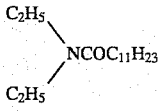
Cpd-A
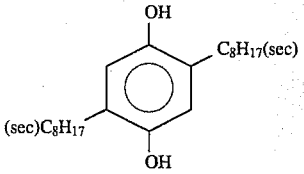
Cpd-B
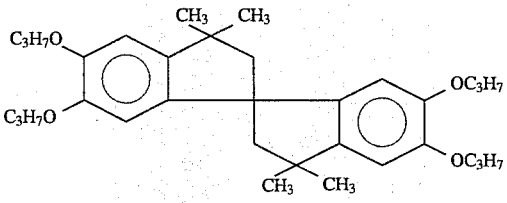
Cpd-C
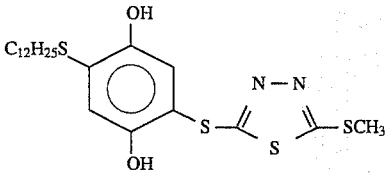
Cpd-D
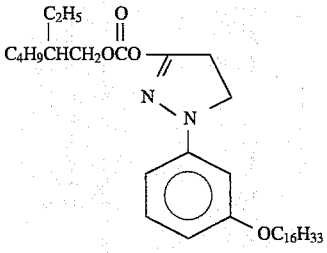
Cpd-E
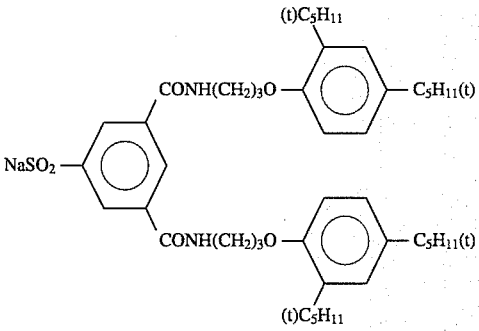

-continued
Cpd-F
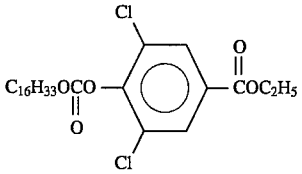
Cpd-G
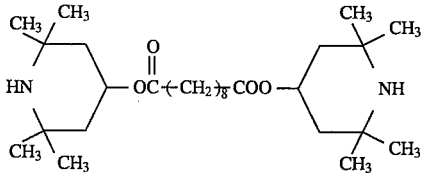
Cpd-H
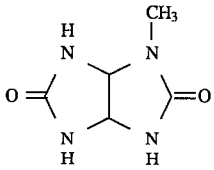
Cpd-I
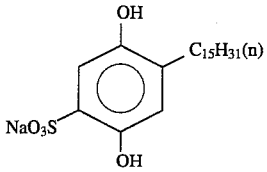
Cpd-J
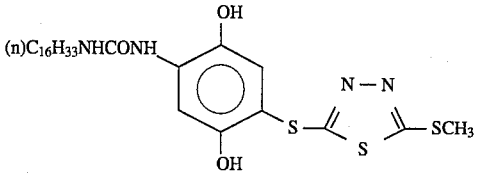
Cpd-K
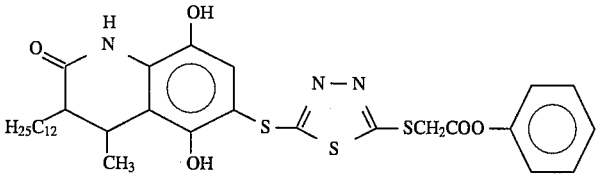
Cpd-L
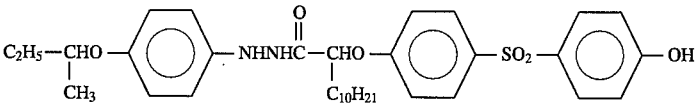
U-1
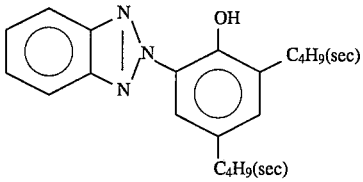
U-2
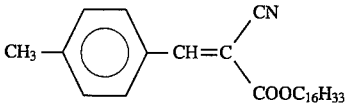
U-3
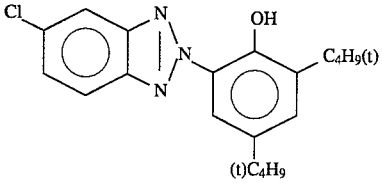
U-4
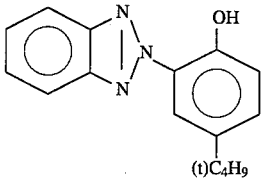
U-5
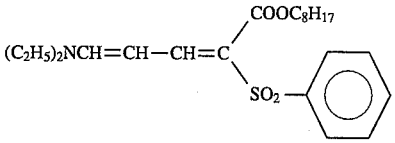
S-1
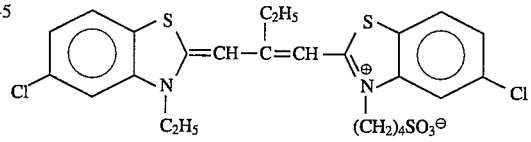
S-2
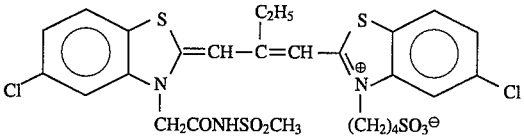
S-3
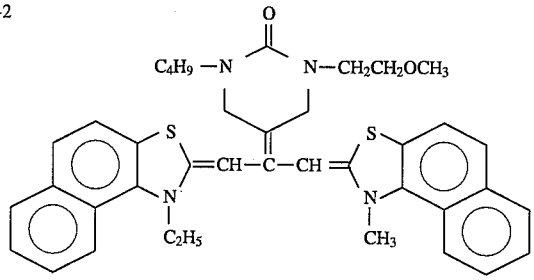

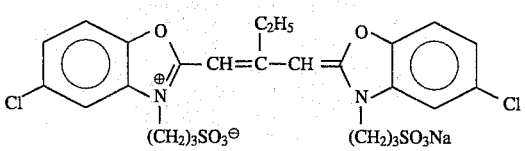
-continued
S-4
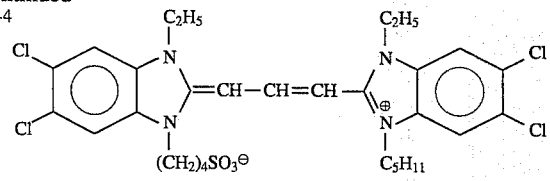
S-5
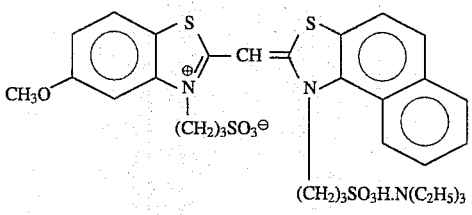
S-6
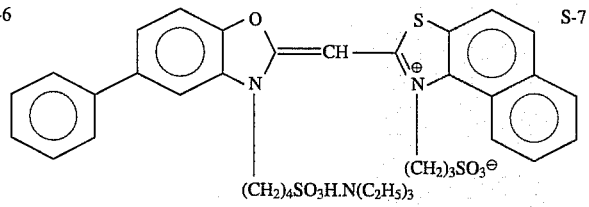
S-7
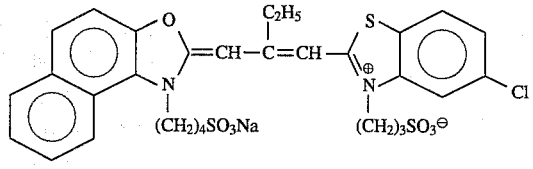
S-8
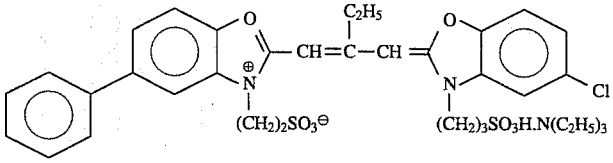
S-9
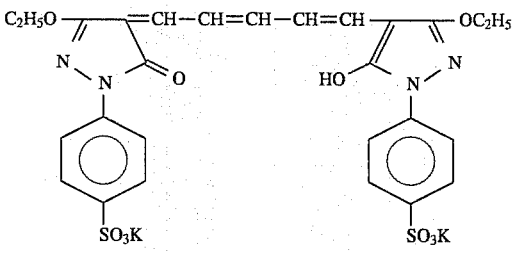
D-1
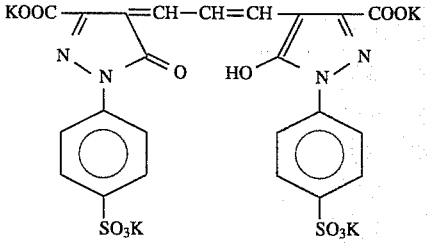
D-2
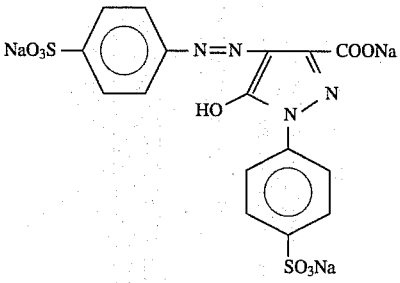
D-3
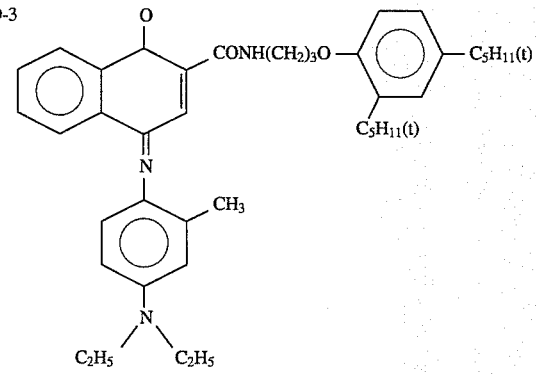
D-4
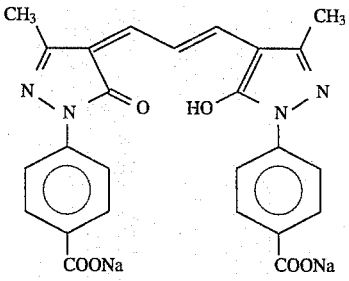
D-5
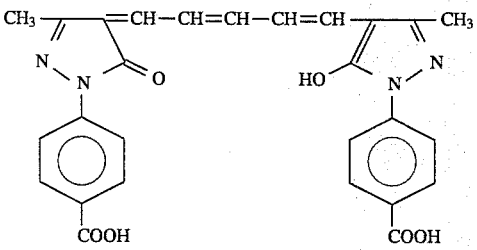
E-1

-continued
E-2
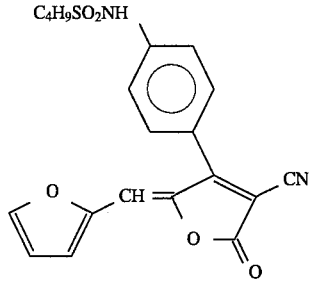
H-1
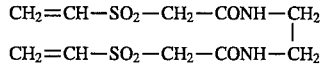
W-1
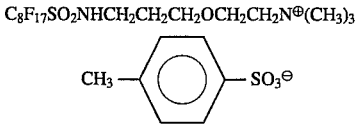
W-2
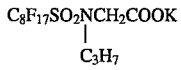
W-3
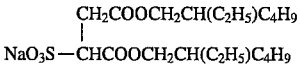
W-4
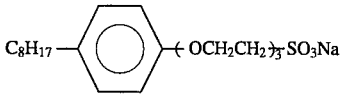
W-5
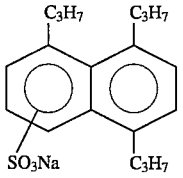
W-6
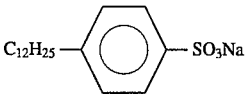
P-1
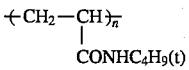
n = 100–1000
M-1
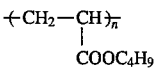
n = 100–1000
F-1
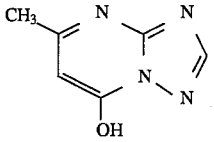
F-2
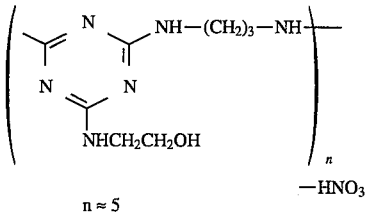
n ≈ 5
F-3
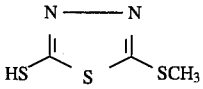
F-4
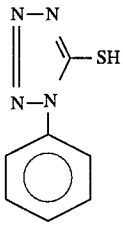
F-5
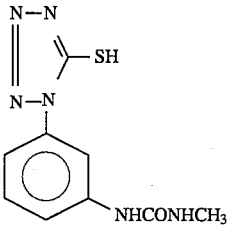
F-6
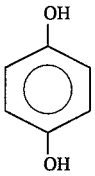

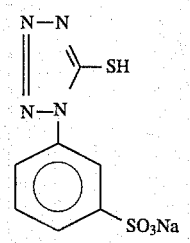

-continued

F-7

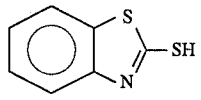

Preparation of Samples 102 to 122:

Samples 102 to 122 were prepared by following the same procedure as in the preparation of Sample 101 except that Couplers C-4 and C-7 used for layers 9 to 11 in Sample 101 were changed to the comparison couplers and the couplers of this invention shown in Table 3 below.

The comparison couplers shown in Table 3 are shown below.

Comparison Couplers (Coupler (4) described in JP-A-56-133734)

(ex1)

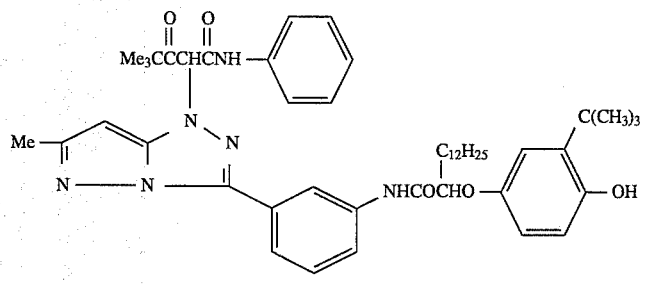

(Coupler (6) described in JP-A-56-133734)

(ex2)

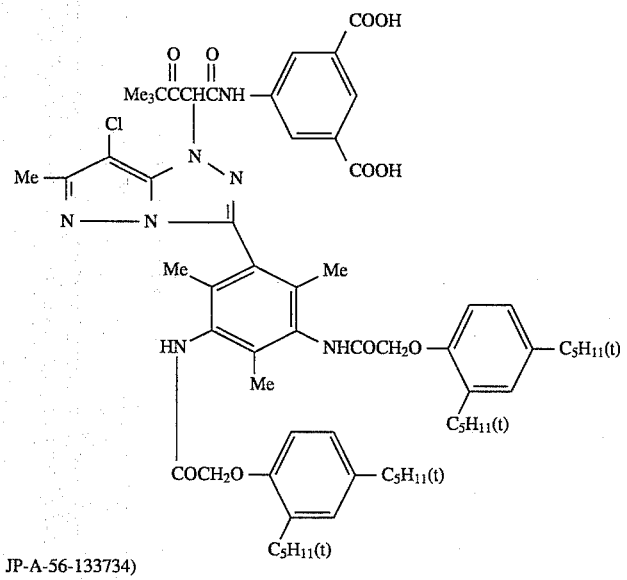

(Coupler (7) described in JP-A-56-133734)

(ex3)

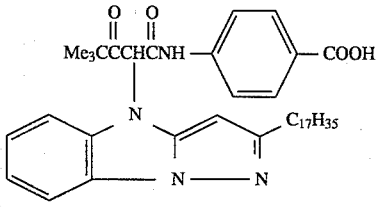

(Coupler (1) described in JP-a-60-191253)

-continued
Comparison Couplers
(ex4)
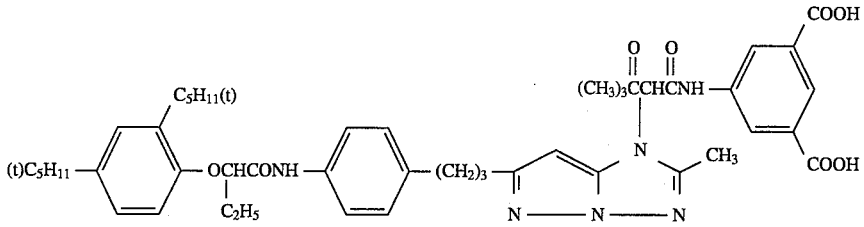
(ex5)
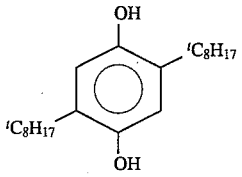
(Coupler (13) described in JP-a-60-191253)
(ex6)
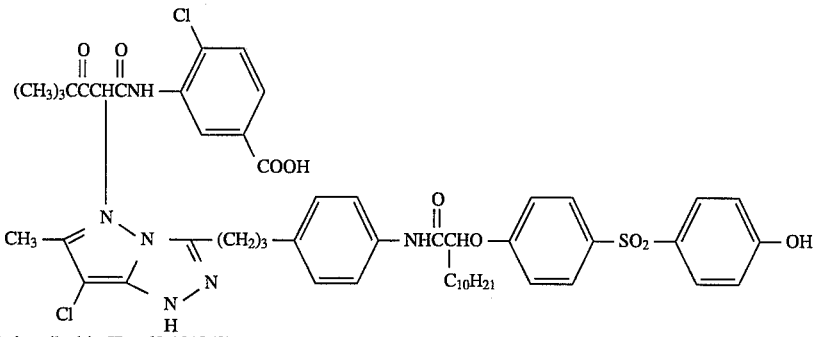
(Coupler (30) described in JP-a-60-191253)
(ex7)
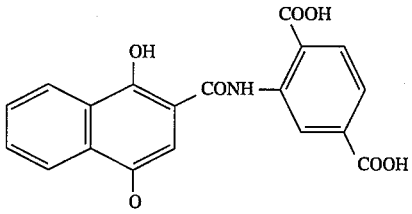
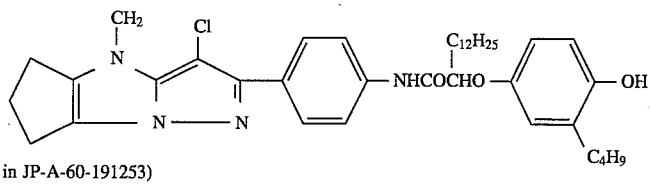
(coupler (31) described in JP-A-60-191253)
(ex8)
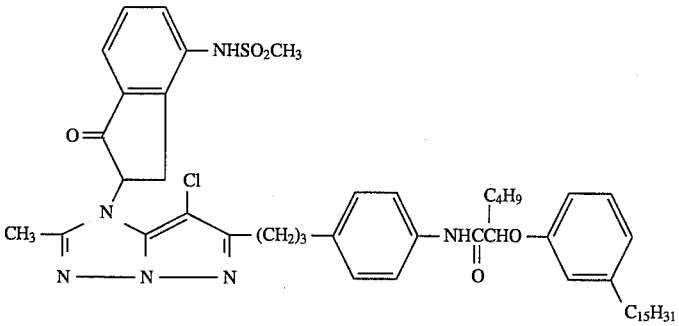
(Coupler (36) described in JP-A-60-191253)

-continued

Comparison Couplers (ex9)

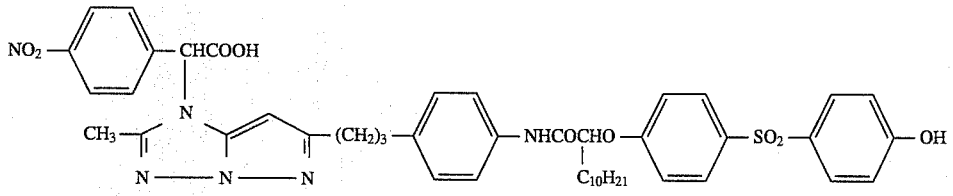

(Coupler (42) described in JP-A-60-191253)

(ex10)

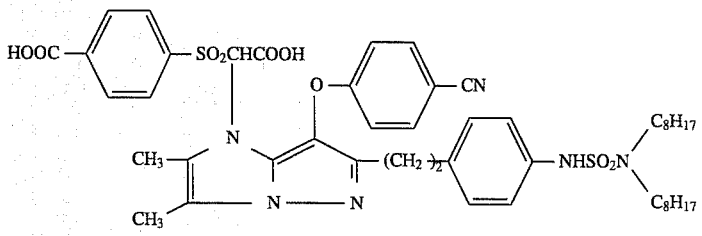

Each of the samples thus prepared was slit into a strip form, subjected to a wedge exposure in a conventional manner, processed using the following processing steps, and then the sensitivity and the maximum density thereof were evaluated.

After exposing each sample, each sample was processed in the following sequential steps.

| Processing Steps | Time | Temperature |
|---|---|---|
| First Development | 6 min. | 38° C. |
| Wash | 2 min. | 38° C. |
| Reversal | 2 min. | 38° C. |
| Color Development | 6 min. | 38° C. |
| Control | 2 min. | 38° C. |
| Bleach | 6 min. | 38° C. |
| Fix | 4 min. | 38° C. |
| Wash | 4 min. | 38° C. |
| Stabilization | 1 min. | 25° C. |

The composition of each processing solution was as follows.

| First Developer | |
|---|---|
| Nitrilo-N,N,N-trimethylenephosphonic Acid.Penta-Sodium Salt | 1.5 g |
| Diethylenetriaminepentaacetic Acid.PentaSodium Salt | 2.0 g |
| Sodium Sulfite | 30 g |
| Hydroquinone.Potassium Monosulfonate | 20 g |
| Potassium Carbonate | 15 g |
| Sodium Bicarbonate | 12 g |
| 1-Phenyl-4-methyl-4-hydroxymethyl-3-pyrazolidone | 1.5 g |
| Potassium Bromide | 2.5 g |
| Potassium Thiocyanate | 1.2 g |
| Potassium Iodide | 2.0 mg |
| Diethylene Glycol | 13 g |
| Water to make | 1000 ml |
| pH | 9.60 |

The pH was controlled using hydrochloric acid or potassium hydroxide.

| Reversal Solution | |
|---|---|
| Nitrilo-N,N,N-trimethylenephosphonic Acid.Penta-Sodium Salt | 3.0 g |
| Stannous Chloride.Di-Hydrate | 1.0 g |
| p-Aminophenol | 0.1 g |
| Sodium Hydroxide | 8 g |
| Glacial Acetic Acid | 15 ml |
| Water to make | 1000 ml |
| pH | 6.00 |

The pH was controlled using hydrochloric acid or sodium hydroxide.

| Color Developer | |
|---|---|
| Nitrilo-N,N,N-trimethylenephosphonic Acid.Penta-Sodium Salt | 2.0 g |
| Sodium Sulfite | 7.0 g |
| Sodium Tertiary Phosphate.12$H_2O$ | 36 g |
| Potassium Bromide | 1.0 g |
| Potassium Iodide | 90 mg |
| Sodium Hydroxide | 3.0 g |
| Citrazinic Acid | 1.5 g |
| N-Ethyl-N-(β-methanesulfonamidoethyl)-3-methyl-4-aminoaniline.3/2Sulfate. Monohydrate | 11 g |
| 3,6-Dithiaoctane-1,8-diol | 1.0 g |
| Water to make | 1000 ml |
| pH | 11.80 |

The pH was controlled using hydrochloric acid or potassium hydroxide.

| Control Solutiion | |
|---|---|
| Ethylenediaminetetraacetic Acid.Di-Sodium Salt.Di-Hydrate | 8.0 g |
| Sodium Sulfite | 12 g |
| 1-Thioglycerol | 0.4 g |
| Formaldehyde-Sodium Bisulfite Addition Product | 30 g |
| Water to make | 1000 ml |

-continued

| Control Solutiion | |
|---|---|
| pH | 6.20 |

The pH was controlled using hydrochloric acid or sodium hydroxide.

| Bleaching Solution | |
|---|---|
| Ethylenediaminetetraacetic Acid.Di-Sodium Salt.Di-Hydrate | 2.0 g |
| Ethylenediaminetetraacetic Acid.Fe(III).Ammonium.Di-Hydrate | 120 g |
| Potassium Bromide | 100 g |
| Ammonium Nitrate | 10 g |
| Water to make | 1000 ml |
| pH | 5.70 |

-continued

| Stabilization Solution | |
|---|---|
| Water to make | 1000 ml |
| pH | 7.0 |

The maximum density was almost the same in Samples 101 to 122. To evaluate the graininess of each sample, the RMS graininess thereof was measured (measuring aperture 48 μmϕ).

Also, for evaluating the decoloring property of flow out-type comparison couplers, the sample was subjected to a magenta selective exposure and the color turbidity of the maximum density portion of the sample after processing was visually observed. The color turbidity was evaluated in 3 ranks as follows, where x=very high color turbidity, Δ=slightly high color turbidity, o=very low color turbidity.

The results obtained are shown in Table 3 below.

TABLE 3

| Sample No. | Coupler/Compound Added to Layers 9 to 11 | Amount (mol ratio) | Sensitivity ((logE) at point of D = 1.0) | RMS Graininess (at D = 1.0) | Color Turbidity (at maximum density portion on magenta selective exposure) |
|---|---|---|---|---|---|
| 101 (Comparison) | C-4/C-7 | ×1.0 (control) | 0.00 (control) | 0.015 | X |
| 102 (Comparison) | ex1 | ×1.5 | −0.07 | 0.023 | X |
| 103 (Comparison) | ex2 | ×1.7 | −0.08 | 0.023 | Δ |
| 104 (Comparison) | ex3 | ×2.0 | −0.12 | 0.020 | X |
| 105 (Comparison) | M-1 + ex4 | ×1.15 | +0.02 | 0.032 | o |
| 106 (Comparison) | ex5 | ×1.5 | −0.08 | 0.024 | X |
| 107 (Comparison) | ex6 | ×1.4 | −0.07 | 0.022 | Δ |
| 108 (Comparison) | ex7 | ×1.4 | −0.07 | 0.022 | Δ |
| 109 (Comparison) | ex8 | ×2.2 | −0.15 | 0.021 | Δ |
| 110 (Comparison) | ex9 | ×2.0 | −0.15 | 0.021 | o none |
| 111 (Comparison) | ex10 | ×1.9 | −0.13 | 0.020 | o none |
| 112 (Invention) | M-1 | ×1.1 | −0.01 | 0.014 | o none |
| 113 (Invention) | M-2 | ×1.0 | −0.01 | 0.015 | o none |
| 114 (Invention) | M-5 | ×1.1 | ±0 | 0.013 | o none |
| 115 (Invention) | M-6 | ×1.0 | ±0.01 | 0.014 | o none |
| 116 (Invention) | M-9 | ×1.0 | ±0 | 0.015 | o none |
| 117 (Invention) | M-10 | ×1.2 | −0.02 | 0.017 | o none |
| 118 (Invention) | M-18 | ×1.3 | −0.02 | 0.017 | o none |
| 119 (Invention) | M-22 | ×1.3 | −0.03 | 0.018 | o none |
| 120 (Invention) | M-23 | ×1.3 | −0.03 | 0.017 | o none |
| 121 (Invention) | M-26 | ×1.3 | −0.01 | 0.014 | o none |
| 122 (Invention) | M-27 | ×1.3 | −0.02 | 0.015 | o none |

The pH was controlled using hydrochloric acid or sodium hydroxide.

| Fixing solution | |
|---|---|
| Ammonium Thiosulfate | 80 g |
| Sodium Sulfite | 5.0 g |
| Sodium Bisulfite | 5.0 g |
| Water to make | 1000 ml |
| pH | 6.60 |

The pH was controlled using hydrochloric acid or aqueous ammonium.

| Stabilization Solution | |
|---|---|
| Benzoisothiazolin-3-one | 0.02 g |
| Polyoxyethylene-p-monononylphenyl Ether (average polymerization degree 10) | 0.3 g |

As is clear from the results shown in Table 3 above, it can be seen that when the coupler of the present invention is used, the amount of the coupler added is less than the amount of the comparison coupler and the coupler gives a maximum color density almost same as that with a pyrazolone four-equivalent coupler at an equimolar amount to that of the four-equivalent coupler. This means that the sharpness is not deteriorated by increasing the amount of the coupler coated. Also, the results show that sensitivity reduction is less and the intramolecular hydrazine derivative-type coupler of the present invention functions as an effective poly-equivalent coupler. Also, it is clear that the deterioration of the graininess is less and the coupler of the present invention has quite excellent characteristics for image quality. Furthermore, in the case of using the coupler-releasing coupler shown in the comparison sample, color turbidity frequently occurs at the maximum density portions as a result of inferior decoloring of the water-soluble dye formed. However, since there is no coloring by the hydrazine decomposed product in the case of using the coupler of the present invention, no color turbidity occurs. Also, in the case of mixing with the hydroquinone derivative, there is neither sensitivity reduction nor occurrence of color turbidity, but deterioration of the graininess is severe.

As is clear from the example described above, by using the coupler of the present invention, the hue characteristics of the pyrazoloazole and indazolone series couplers can be sufficiently obtained and also the disadvantages about the photographic performance such as sensitivity, graininess, etc., can be effectively overcome.

While the invention has been described in detail and with reference to specific embodiments thereof, it will be apparent to one skilled in the art that various changes and modifications can be made therein without departing from the spirit and scope thereof.

What is claimed is:

1. A silver halide color reversal photographic material comprising a support having thereon at least one layer containing a hydrazide compound represented by the following formula (1):

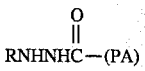

(1)

wherein R represents an alkyl group, an aryl group, or an aromatic heterocyclic group, and (PA) represents a pyrazoloazole coupler residue or an indazolone coupler residue selected from the group consisting of the residues of the compounds having the following formulas (M-I) to (M-VII):

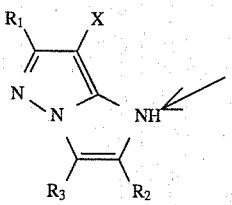

(M-I)

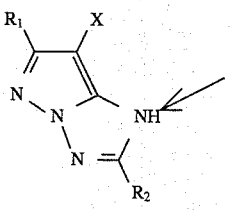

(M-II)

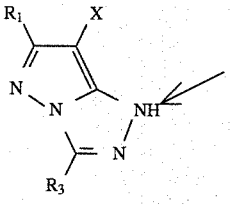

(M-III)

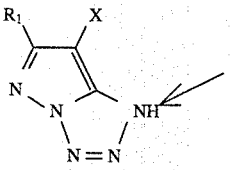

(M-IV)

-continued

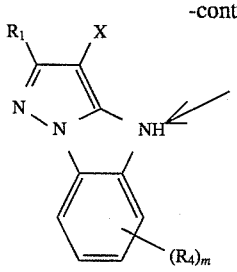

(M-V)

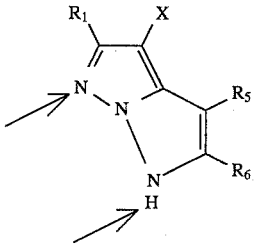

(M-VI)

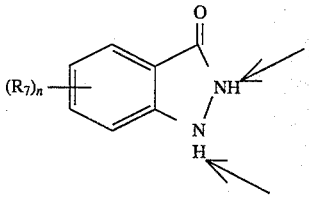

(M-VII)

wherein $R_1$, $R_2$, $R_3$, $R_4$, $R_5$, $R_6$ and $R_7$ each represents a hydrogen atom, a halogen atom, an alkyl group, an aryl group, a heterocyclic group, a cyano group, a hydroxy group, a nitro group, a carboxy group, a sulfo group, an amino group, an alkoxy group, an aryloxy group, an acylamino group, an alkylamino group, an anilino group, a ureido group, a sulfamoylamino group, an alkylthio group, an arylthio group, an alkoxycarbonylamino group, a sulfonamido group, a carbamoyl group, a sulfamoyl group, a sulfonyl group, an alkoxycarbonyl group, a heterocyclic oxy group, an azo group, an acyloxy group, a carbamoyloxy group, a silyl group, a silyloxy group, an aryloxycarbonylamino group, an imido group, a heterocyclic thio group, a sulfinyl group, a phosphonyl group, an aryloxycarbonyl group, an acyl group or an azolyl group; m and n each represents an integer of from 1 to 4; X represents a hydrogen atom or a group releasable on reaction of the hydrazide compound shown by formula (1) and the oxidation product of an aromatic primary amine color developing agent; and → represents the bonding position(s) of the pyrazoloazole coupler residue or indazolone coupler residue to the hydrazide compound of formula (1).

2. The silver halide color reversal photographic material of claim 1, wherein, in formula (1), the alkyl group for R is a straight chain or branched chain alkyl group having from 1 to 40 carbon atoms, the aryl group for R is an aryl group having 6 to 40 carbon atoms and the aromatic heterocyclic group for R is an aromatic heterocyclic group having from 1 to 40 carbon atoms and containing one or more of a nitrogen atom, a sulfur atom or an oxygen atom as a hetero atom.

3. The silver halide color reversal photographic material of claim 1, wherein R in formula (1) may include one or more substituents selected from the group consisting of a halogen atom, an alkyl group, an aryl group, a heterocyclic group, a cyano group, a hydroxy group, a nitro group, a carboxy group, a sulfo group, an amino group, an alkoxy group, an aryloxy group, an acylamino group, an alkylamino group, an anilino group, a ureido group, a sulfamoylamino group, an alkylthio group, an arylthio group, an alkoxycarbonylamino group, a sulfonamido group, a carbamoyl group, a sulfamoyl group, a sulfonyl group, an alkoxycarbonyl group, a heterocyclic oxy group, an azo group, an acyloxy group, a carbamoyloxy group, a silyl group, a silyloxy group, an aryloxycarbonylamino group, an imido group, a heterocyclic thio group, a sulfinyl group, a phosphonyl group, an aryloxycarbonyl group, an acyl group and an azolyl group.

4. The silver halide color reversal photographic material of claim 1, wherein R in formula (1) is divalent and the hydrazide compound represented by the formula (I) is a bis compound.

5. The silver halide color reversal photographic material of claim 1, wherein R in formula (1) is an aryl group or an aromatic heterocyclic group.

6. The silver halide color reversal photographic material of claim 1, wherein R in formula (1) is an aryl group.

7. The silver halide color reversal photographic material of claim 1, wherein (PA) is the pyrazoloazole coupler residue or indazolone coupler residue represented by formula (M-III) or formula (M-V).

8. The silver halide color reversal photographic material of claim 7, wherein X represents a hydrogen atom, a halogen atom, an alkoxy group, an aryloxy group, an acyloxy group, an alkylsulfonyloxy group, an arylsulfonyloxy group, an acylamino group, an alkylsulfonamido group, an arylsulfonamido group, an alkoxycarbonyloxy group, an aryloxycarbonyloxy group, an alkylthio group, an arylthio group, a heterocyclic thio group, a carbamoylamino group, a 5 -membered or 6-membered nitrogen-containing heterocyclic group, an imido group or an arylazo group.

9. The silver halide color reversal photographic material of claim 1, wherein said silver halide color photographic material comprises at least one blue-sensitive silver halide emulsion layer, at least one green-sensitive silver halide emulsion layer, and at least one red-sensitive silver halide emulsion layer on a support.

* * * * *